US010619484B2

(12) United States Patent
Chouhan et al.

(10) Patent No.: US 10,619,484 B2
(45) Date of Patent: Apr. 14, 2020

(54) TURBINE BUCKET COOLING

(71) Applicant: General Electric Company, Schenectady, NY (US)

(72) Inventors: Rohit Chouhan, Bangalore (IN); Soumyik Kumar Bhaumik, Bangalore (IN); Clint Luigie Ingram, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 430 days.

(21) Appl. No.: 15/216,881

(22) Filed: Jul. 22, 2016

(65) Prior Publication Data

US 2016/0326879 A1 Nov. 10, 2016

Related U.S. Application Data

(63) Continuation-in-part of application No. 14/603,316, filed on Jan. 22, 2015.

(51) Int. Cl.
*F01D 5/08* (2006.01)
*F01D 5/14* (2006.01)
(Continued)

(52) U.S. Cl.
CPC ..... *F01D 5/082* (2013.01); *F01D 5/145* (2013.01); *F01D 11/001* (2013.01); *F01D 11/02* (2013.01);
(Continued)

(58) Field of Classification Search
None
See application file for complete search history.

(56) References Cited

U.S. PATENT DOCUMENTS 5,211,533 A 5/1993 Walker et al.
5,222,742 A 6/1993 Roberts
(Continued)

FOREIGN PATENT DOCUMENTS

CN 102678189 A 9/2012
CN 104937215 B 8/2017
(Continued)

OTHER PUBLICATIONS

U.S. Appl. No. 15/217,212, Office Action 2 dated Dec. 14, 2017, 14 pages.
(Continued)

*Primary Examiner* — Igor Kershteyn
*Assistant Examiner* — Jason G Davis
(74) *Attorney, Agent, or Firm* — Dale Davis; Hoffman Warnick LLC

(57) ABSTRACT

Embodiments of the invention relate generally to rotary machines and, more particularly, to the cooling of at least portions of a turbine bucket. In one embodiment, the invention provides a method of cooling at least a portion of a turbine bucket, the method comprising: during operation of a turbine, altering a swirl velocity of purge air beneath a platform lip extending axially from the platform, wherein altering the swirl velocity of the purge air includes interrupting a flow of the purge air with a plurality of voids disposed along a length of an angel wing extending axially from a face of a shank portion of the turbine bucket.

6 Claims, 20 Drawing Sheets

(51) Int. Cl.
*F01D 11/02* (2006.01)
*F01D 11/00* (2006.01)

(52) U.S. Cl.
CPC .... *F05D 2240/127* (2013.01); *F05D 2240/80* (2013.01); *F05D 2260/20* (2013.01); *F05D 2260/941* (2013.01)

(56) References Cited

U.S. PATENT DOCUMENTS

| | | | | |
|---|---|---|---|---|
| 5,417,545 | A | 5/1995 | Harrogate | |
| 5,893,984 | A | 4/1999 | Thompson | |
| 6,077,035 | A | 7/2000 | Walters et al. | |
| 6,783,323 | B2 | 8/2004 | Shiozaki et al. | |
| 7,044,710 | B2 | 5/2006 | Naik et al. | |
| 7,114,339 | B2 | 10/2006 | Alvanos et al. | |
| 7,189,055 | B2 | 3/2007 | Marini et al. | |
| 7,189,056 | B2 | 3/2007 | Girgis et al. | |
| 7,244,104 | B2 | 7/2007 | Girgis et al. | |
| 7,665,964 | B2 | 2/2010 | Taylor et al. | |
| 8,057,178 | B2 | 11/2011 | Itzel et al. | |
| 8,083,475 | B2 | 12/2011 | Bulgrin et al. | |
| 8,186,952 | B2 | 5/2012 | Tibbott | |
| 8,419,356 | B2 | 4/2013 | Little | |
| 8,834,122 | B2 * | 9/2014 | Ingram | F01D 11/001 416/191 |
| 8,939,711 | B2 | 1/2015 | Lee et al. | |
| 8,979,481 | B2 * | 3/2015 | Ingram | F01D 11/04 415/115 |
| 9,039,357 | B2 | 5/2015 | Lee | |
| 9,121,298 | B2 | 9/2015 | Lee et al. | |
| 2006/0269399 | A1 | 11/2006 | Girgis et al. | |
| 2010/0074733 | A1 | 3/2010 | Little | |
| 2010/0074734 | A1 | 3/2010 | Little | |
| 2012/0163955 | A1 | 6/2012 | Devi et al. | |
| 2012/0251291 | A1 | 10/2012 | Ledezma et al. | |
| 2013/0108441 | A1 | 5/2013 | Ingram | |
| 2013/0108451 | A1 | 5/2013 | Ingram | |
| 2013/0139386 | A1 | 6/2013 | Lacy et al. | |
| 2013/0170983 | A1 | 7/2013 | Babu et al. | |
| 2013/0189073 | A1 | 7/2013 | Adaickalasamy | |
| 2013/0302141 | A1 | 11/2013 | Quach et al. | |
| 2014/0003919 | A1 | 1/2014 | Lee et al. | |
| 2014/0147250 | A1 | 5/2014 | Lee et al. | |
| 2014/0205441 | A1 | 7/2014 | Lee | |
| 2014/0205443 | A1 | 7/2014 | Lee et al. | |
| 2014/0234076 | A1 | 8/2014 | Lee et al. | |
| 2014/0271111 | A1 | 9/2014 | Ballard, Jr. et al. | |
| 2014/0286760 | A1 | 9/2014 | Lee | |
| 2016/0215624 | A1 | 7/2016 | Chouhan et al. | |

FOREIGN PATENT DOCUMENTS

| | | | |
|---|---|---|---|
| DE | 10 2006 043 744 | A1 | 3/2007 |
| EP | 1 895 108 | A2 | 3/2008 |
| EP | 2 093 381 | A1 | 8/2009 |
| EP | 2 116 692 | A2 | 11/2009 |
| EP | 2581555 | A1 | 4/2013 |
| EP | 2586995 | A2 | 5/2013 |
| EP | 2586996 | A2 | 5/2013 |
| GB | 2251040 | A | 6/1992 |
| JP | 2004036510 | A | 2/2004 |
| JP | 2004100578 | A | 4/2004 |
| JP | 2005036722 | A | 2/2005 |
| JP | 2006077658 | A | 3/2006 |
| JP | 2013119855 | A | 6/2013 |
| JP | 2013151936 | A | 8/2013 |
| JP | 2016501341 | A | 1/2016 |
| JP | 2016505771 | A | 2/2016 |
| WO | 2011029420 | A1 | 3/2011 |

OTHER PUBLICATIONS

U.S. Appl. No. 14/603,314, Office Action dated Dec. 29, 2017, 27 pages.
U.S. Appl. No. 14/603,321, Office Action dated Mar. 7, 2018, 10 pages.
U.S. Appl. No. 14/635,352, Office Action dated Mar. 29, 2018, 14 pages.
U.S. Appl. No. 14/603,314, Final Office Action dated Apr. 3, 2018, 13 pages.
U.S. Appl. No. 14/603,318, Office Action dated Apr. 3, 2018, 12 pages.
U.S. Appl. No. 15/217,212, Final Office Action dated Apr. 5, 2018, 14 pages.
Extended European Search Report and Opinion issued in connection with corresponding EP Application No. 17181938.6 dated Nov. 23, 2017.
U.S. Appl. No. 14/603,318, Office Action 1 dated Jun. 14, 2017, 26 pages.
U.S. Appl. No. 15/217,212, Office Action 1 dated Jul. 3, 2017, 16 pages.
U.S. Appl. No. 14/603,314, Final Office Action 1 dated Jul. 13, 2017, 17 pages.
U.S. Appl. No. 14/635,352, Office Action 2 dated Sep. 13, 2017, 12 pages.
European Search Report and Opinion in relation to U.S. Appl. No. 14/603,316 dated Jun. 28, 2016, 7 pages.
European Search Report and Opinion in relation to U.S. Appl. No. 14/603,321 dated Jun. 28, 2016, 6 pages.
European Search Report and Opinion in related to U.S. Appl. No. 14/635,352, dated Jul. 12, 2016, 8 pages.
Extended European Search Report and Opinion issued in connection with related EP Application No. 16152213.1 dated Dec. 21, 2016.
Chouhan, et al., Jan. 22, 2015, U.S. Appl. No. 14/603,321.
Chouhan, et al, Jan. 22, 2015, U.S. Appl. No. 14/603,318.
Chouhan, et al, Jan. 22, 2015, U.S. Appl. No. 14/603,316.
Chouhan, et al, Jan. 22, 2015, U.S. Appl. No. 14/603,314.
Chouhan, et al, Sep. 7, 2016, U.S. Appl. No. 15/257,986.
Chouhan, et al, Jul. 22, 2016, U.S. Appl. No. 15/217,212.
U.S. Appl. No. 14/635,352, Office Action 1 dated Mar. 9, 2017, 42 pages.
U.S. Appl. No. 14/603,314, Office Action 1 dated Mar. 24, 2017, 40 pages.
U.S. Appl. No. 14/603,321, Office Action 1 dated Apr. 13, 2017, 30 pages.
U.S. Appl. No. 14/603,316, Office Action 1 dated May 31, 2017, 39 pages.
U.S. Appl. No. 14/635,352, Final Office Action dated Jun. 29, 2018, 8 pages.
U.S. Appl. No. 14/603,316, Final Office Action 1 dated Sep. 15, 2017, 24 pages.
U.S. Appl. No. 14/603,321, Final Office Action 1 dated Sep. 22, 2017, 27 pages.
U.S. Appl. No. 14/603,318, Final Office Action 1 dated Nov. 27, 2017, 15 pages.
U.S. Appl. No. 14/635,352, Final Office Action 1 dated Dec. 6, 2017, 13 pages.
Office Action and English Translation thereof for Chinese Patent Application No. 201610116856.4 dated Dec. 24, 2018, 15 pages.
U.S. Appl. No. 14/603,318, Final Office Action dated Sep. 7, 2018, 19 pages.
U.S. Appl. No. 14/603,321, Office Action dated Sep. 10, 2018, 25 pages.
U.S. Appl. No. 15/217,212, Office Action dated Sep. 20, 2018, 16 pages.
U.S. Appl. No. 14/603,314, Office Action dated Sep. 27, 2018, 16 pages.
U.S. Appl. No. 14/603,321, Final Office Action dated Mar. 28, 2019, 12 pgs.
U.S. Appl. No. 15/217,212, Final Office Action dated Apr. 12, 2019, 9 pages.
U.S. Appl. No. 14/603,314, Final Office Action dated May 1, 2019, 10 pages.
U.S. Appl. No. 14/603,316, Notice of Allowance dated May 21, 2019, 8 pages.

(56) References Cited

OTHER PUBLICATIONS

U.S. Appl. No. 14/603,321, Notice of Allowance dated Nov. 6, 2019, 3 pages.
U.S. Appl. No. 14/603,321, Office Action dated Jul. 29, 2019, 15 pages.
U.S. Appl. No. 14/603,316, Office Action dated Sep. 12, 2019, 14 pages.
U.S. Appl. No. 14/603,321, Final Office Action dated Sep. 20, 2019, 9 pages.
U.S. Appl. No. 15/217,212, Office Action dated Oct. 2, 2019, 8 pages.
U.S. Appl. No. 14/603,314, Notice of Allowance dated Oct. 2, 2019, 3 pages.
Japanese Office Action Report and Opinion issued in connection with corresponding JP Application No. 2016005703 dated Oct. 31, 2019, 8 pages.
Japanese Office Action Report and Opinion issued in connection with corresponding JP Application No. 2016005741 dated Oct. 23, 2019, 8 pages.
U.S. Appl. No. 14/603,316, Notice of Allowance dated Dec. 20, 2019, 17 pages.
U.S. Appl. No. 15/217,212, Final Office Action dated Jan. 24, 2020, 8 pages.
Machine translation of Office Action issued by Japanese Patent Office dated Nov. 12, 2019, for corresponding JP Application Serial No. 2016-005704.

* cited by examiner

TURBINE BUCKET COOLING

CROSS-REFERENCE TO RELATED APPLICATIONS

This application is a continuation-in-part of co-pending U.S. patent application Ser. No. 14/603,316 filed 22 Jan. 2015, which is incorporated herein as though fully set forth.

BACKGROUND OF THE INVENTION

Embodiments of the invention relate generally to rotary machines and, more particularly, to the cooling of at least portions of a turbine bucket.

As is known in the art, gas turbines employ rows of buckets on the wheels/disks of a rotor assembly, which alternate with rows of stationary vanes on a stator or nozzle assembly. These alternating rows extend axially along the rotor and stator and allow combustion gasses to turn the rotor as the combustion gasses flow therethrough.

Axial/radial openings at the interface between rotating buckets and stationary nozzles can allow hot combustion gasses to exit the hot gas path and radially enter the intervening wheelspace between bucket rows. To limit such incursion of hot gasses, the bucket structures typically employ axially-projecting angel wings, which cooperate with discourager members extending axially from an adjacent stator or nozzle. These angel wings and discourager members overlap but do not touch, and serve to restrict incursion of hot gasses into the wheelspace.

In addition, cooling air or "purge air" is often introduced into the wheelspace between bucket rows. This purge air serves to cool components and spaces within the wheelspaces and other regions radially inward from the buckets as well as providing a counter flow of cooling air to further restrict incursion of hot gasses into the wheelspace. Angel wing seals therefore are further designed to restrict escape of purge air into the hot gas flowpath.

Nevertheless, most gas turbines exhibit a significant amount of purge air escape into the hot gas flowpath. For example, this purge air escape may be between 0.1% and 3.0% at the first and second stage wheelspaces. The consequent mixing of cooler purge air with the hot gas flowpath results in large mixing losses, due not only to the differences in temperature but also to the differences in flow direction or swirl of the purge air and hot gasses.

In addition, the mixing of purge air and the hot gas flow results in a more chaotic flow of gasses across the platform of the turbine bucket. This increase in chaotic gas flow results in unequal heating of the platform during operation of the turbine, with attendant increases in thermal stresses to the platform and a resultant shortening of the working life of the turbine bucket.

BRIEF DESCRIPTION OF THE INVENTION

In one embodiment, the invention provides a method of cooling at least a portion of a turbine bucket, the method comprising: during operation of a turbine, altering a swirl velocity of purge air beneath a platform lip extending axially from the platform, wherein altering the swirl velocity of the purge air includes interrupting a flow of the purge air with a plurality of voids disposed along a length of an angel wing extending axially from a face of a shank portion of the turbine bucket.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
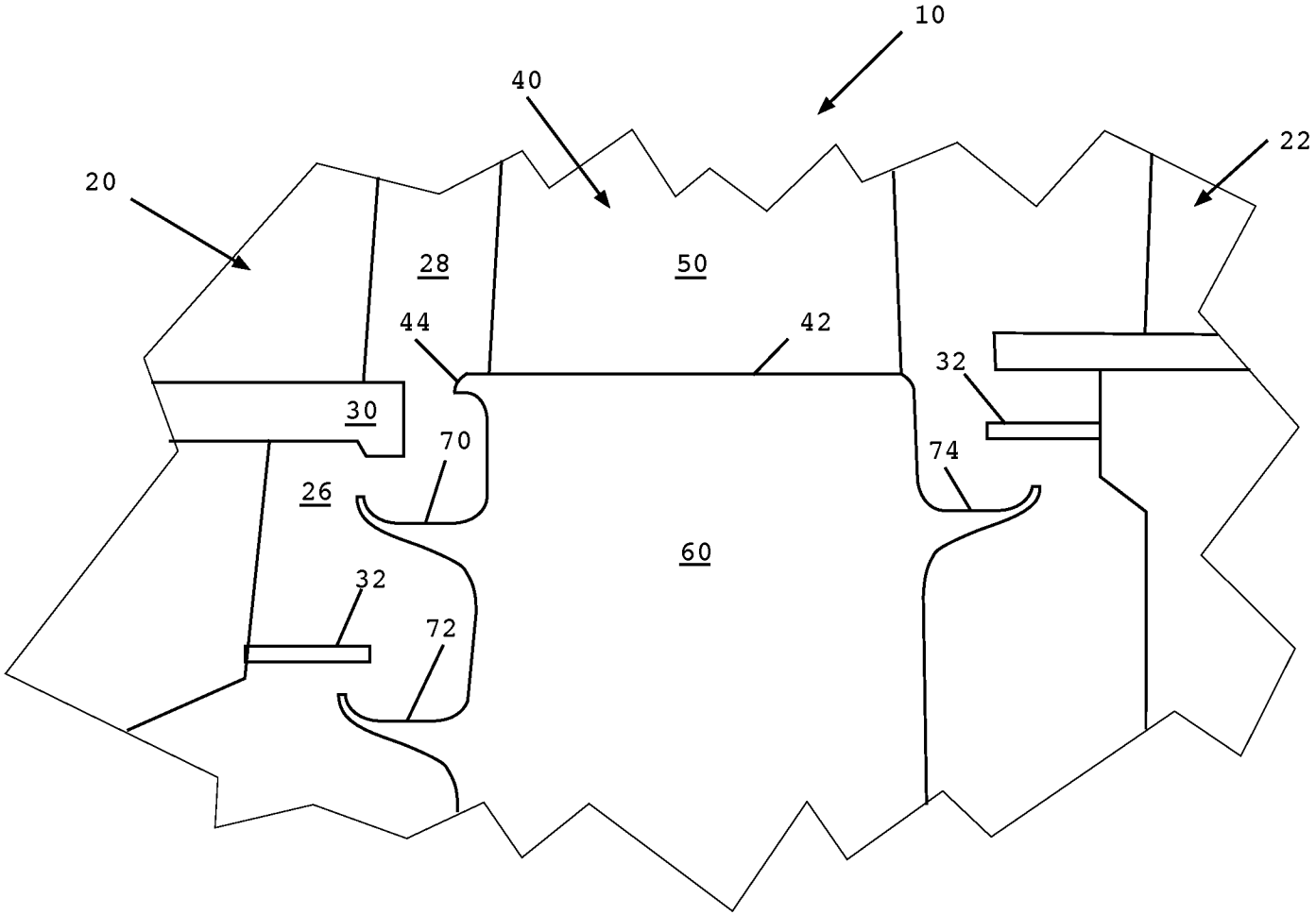
FIG. 1 shows a schematic cross-sectional view of a portion of a known turbine.

Turning now to the drawings, FIG. 1 shows a schematic cross-sectional view of a portion of a gas turbine 10 including a bucket 40 disposed between a first stage nozzle 20 and a second stage nozzle 22. Bucket 40 extends radially outward from an axially extending rotor (not shown), as will be recognized by one skilled in the art. Bucket 40 comprises a substantially planar platform 42, an airfoil extending radially outward from platform 42, and a shank portion 60 extending radially inward from platform 42.

Shank portion 60 includes a pair of angel wing seals 70, 72 extending axially outward toward first stage nozzle 20 and an angel wing seal 74 extending axially outward toward second stage nozzle 22. It should be understood that differing numbers and arrangements of angel wing seals are possible and within the scope of the invention. The number and arrangement of angel wing seals described herein are provided merely for purposes of illustration.

As can be seen in FIG. 1, nozzle surface 30 and discourager member 32 extend axially from first stage nozzle 20 and are disposed radially outward from angel wing seals 70 and 72, respectively. As such, nozzle surface 30 overlaps but does not contact angel wing seal 70 and discourager member 32 overlaps but does not contact angel wing seal 72. A similar arrangement is shown with respect to discourager member 32 of second stage nozzle 22 and angel wing seal 74. In the arrangement shown in FIG. 1, during operation of the turbine, a quantity of purge air may be disposed between, for example, nozzle surface 30, angel wing seal 70, and platform lip 44, thereby restricting both escape of purge air into hot gas flowpath 28 and incursion of hot gasses from hot gas flowpath 28 into wheelspace 26.

As shown in FIG. 1, nozzle surface 30 and discourager member 32 each serves to restrict the escape of purge air and the incursion of hot gasses. In other embodiments of the invention, a separate discourager member, similar to discourager member 32, may be provided between angel wing seal 70 and nozzle surface 30 to provide such function.

While FIG. 1 shows bucket 40 disposed between first stage nozzle 20 and second stage nozzle 22, such that bucket 40 represents a first stage bucket, this is merely for purposes of illustration and explanation. The principles and embodiments of the invention described herein may be applied to a bucket of any stage in the turbine with the expectation of achieving similar results.

Figure 2:
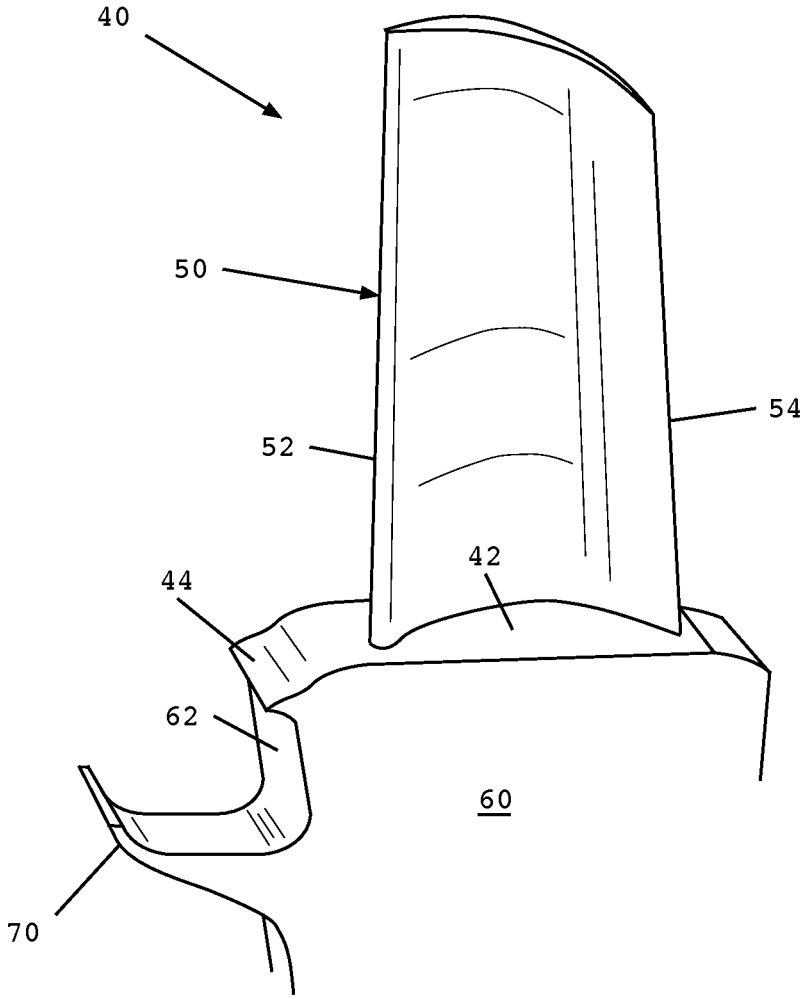
FIG. 2 shows a perspective view of a known turbine bucket.

FIG. 2 shows a perspective view of a portion of bucket 40. As can be seen, airfoil 50 includes a leading edge 52 and a trailing edge 54. Shank portion 60 includes a face 62 nearer leading edge 52 than trailing edge 54, disposed between angel wing 70 and platform lip 44.

Figure 3:
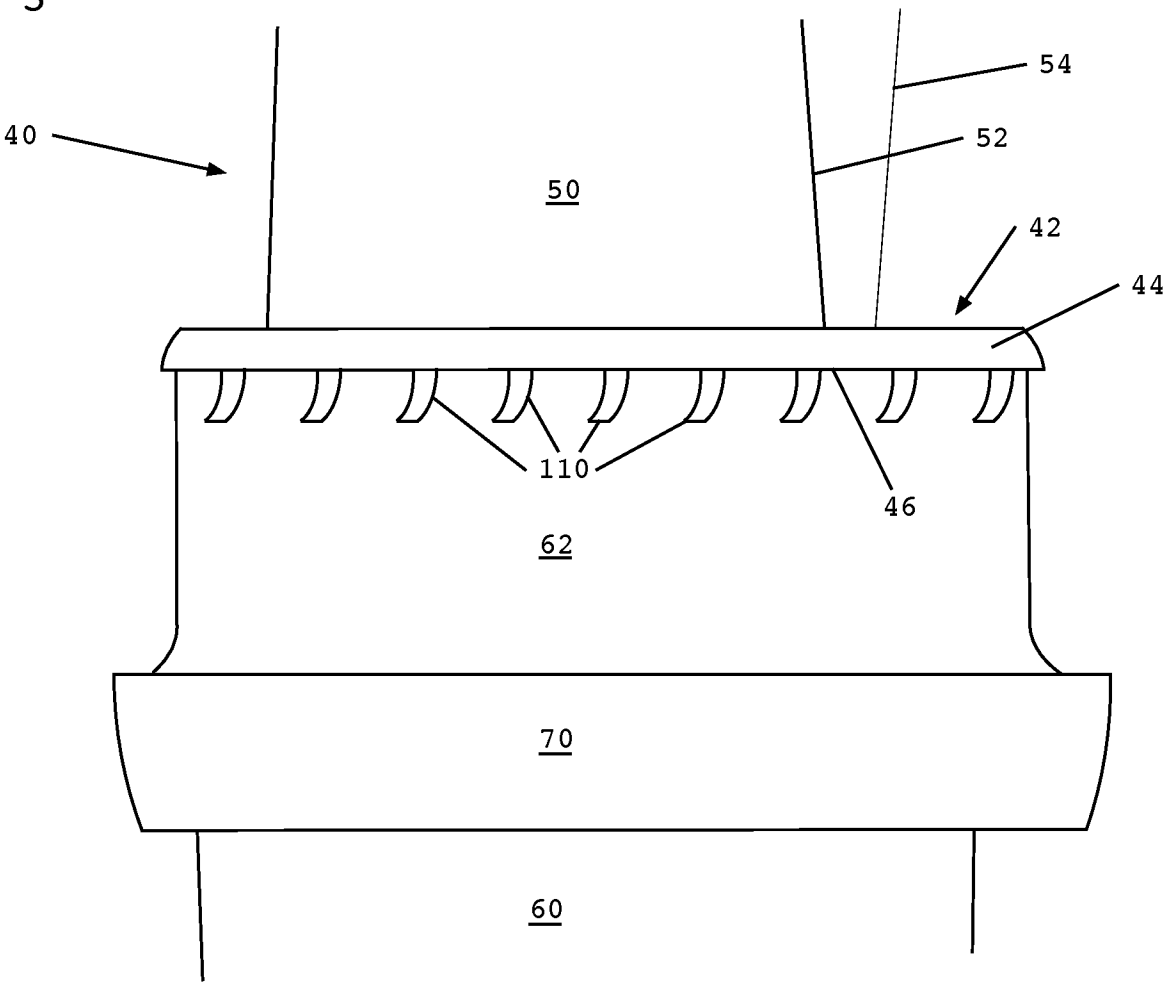
FIG. 3 shows an axially-facing view of a portion of a turbine bucket suitable for use according to an embodiment of the invention.

FIG. 3 shows a schematic view of bucket 40 looking axially toward face 62. As can be seen, bucket 40 includes a plurality of turbulators 110, which, as described in greater detail below, may extend axially outward from face 62 and/or radially inward from a radially inner surface 46 of platform lip 44. As will also be described in greater detail below, turbulators may be of any number of shapes and orientations.

Figure 4:
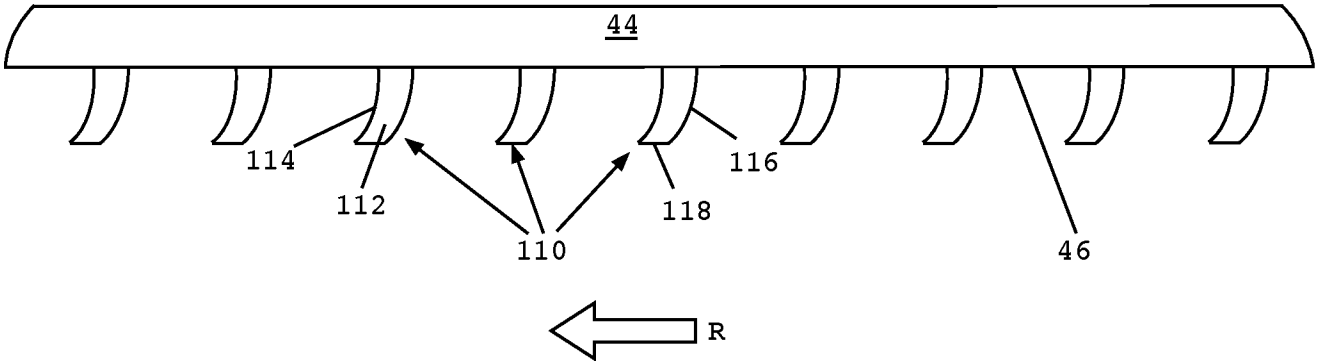
FIG. 4 shows a schematic view of a turbulator suitable for use according to various embodiments of the invention.

For example, FIG. 4 shows a detailed view of lip with turbulators 110, which comprise a first concave face 114 opening toward an intended direction of rotation R of bucket 40 (FIG. 3), a second convex face 116 opposite first concave face 114, and a radially inner face 118 between first and second concave faces 114, 116. These faces 112, 114, 118 form a body 112 of each turbulator 110. In the embodiment of FIG. 4, each turbulator 110 forms a rib-like member extending radially inward from radially inner surface 46 of platform lip 44. In other embodiments of the invention, turbulators may be separated from radially inner surface 46 of platform lip 44 and extend axially outward from face 62 (FIG. 3). In other embodiments the turbulators may be attached to either or both of the radially inner surface 46 of platform lip 44 or face 62 of shank 60. In either case, one or more turbulator 110 may be axially angled, such that, for example, first concave face 114 extends from face 62 at an angle, positive or negative, relative to a longitudinal axis of the turbine. Embodiments of the invention employing axially angled turbulators typically include one or more turbulators which, when installed, are angled ±70 degrees relative to the longitudinal axis of the turbine.

Turbulators 110 draw in purge air and increase its swirl velocity. Generally, a circumferential velocity of purge air coming out of the wheel space cavity is 0.2-0.4 times the local circumferential speed of an adjacent rotor surface. Turbulators according to embodiments of the invention increase this by 0.9-1.1 times by imparting a force onto the purge flow passing through it. This results in a small loss of torque, but regains a much larger favorable torque force when this flow goes through the main bucket 40 and a net gain in efficiency of approximately 0.5% at the turbine stage. This gain is a consequence of both the increased purge air circumferential swirl velocity, which produces a curtaining effect against the ingestion of hot gasses into the wheel space cavity, described further below, as well as a change in a circumferential angle of the purge air onboarding onto the main flow path of the turbine. This change in circumferential angle results in the purge air being better aligned with the hot gas flow, resulting in significantly reduced mixing losses when purge air escapes from wheelspace 26 (FIG. 1) to hot gas flowpath 28 (FIG. 1).

This better alignment of purge air and hot gas flow reduces the flow instability of a flow shear layer and the alternating pockets of low- and high-pressure circumferentially across the opening of wheelspace 26. This results in a reduction of hot gas ingestion and a more even distribution of the film of cold purge air onboarding to the main flowpath 28 across platform 42 (FIG. 1). This film forms a shield between the hot gasses and the metal surface of platform 42. This reduces "hot spots" across platform 42. Such a reduction of hot spots may include a reduction in hot spot size, number, temperature, or all three. As will be explained in greater detail below, this reduction results in a decrease in the overall temperature of platform 42, thereby cooling platform 42, platform lip 44, shank face 62, and airfoil 50, and produces a more uniform heating of platform 42. This in turn reduces thermal gradient induced stresses, increasing life of the component and reducing cooling requirements of platform 42 during operation.

Figure 5:
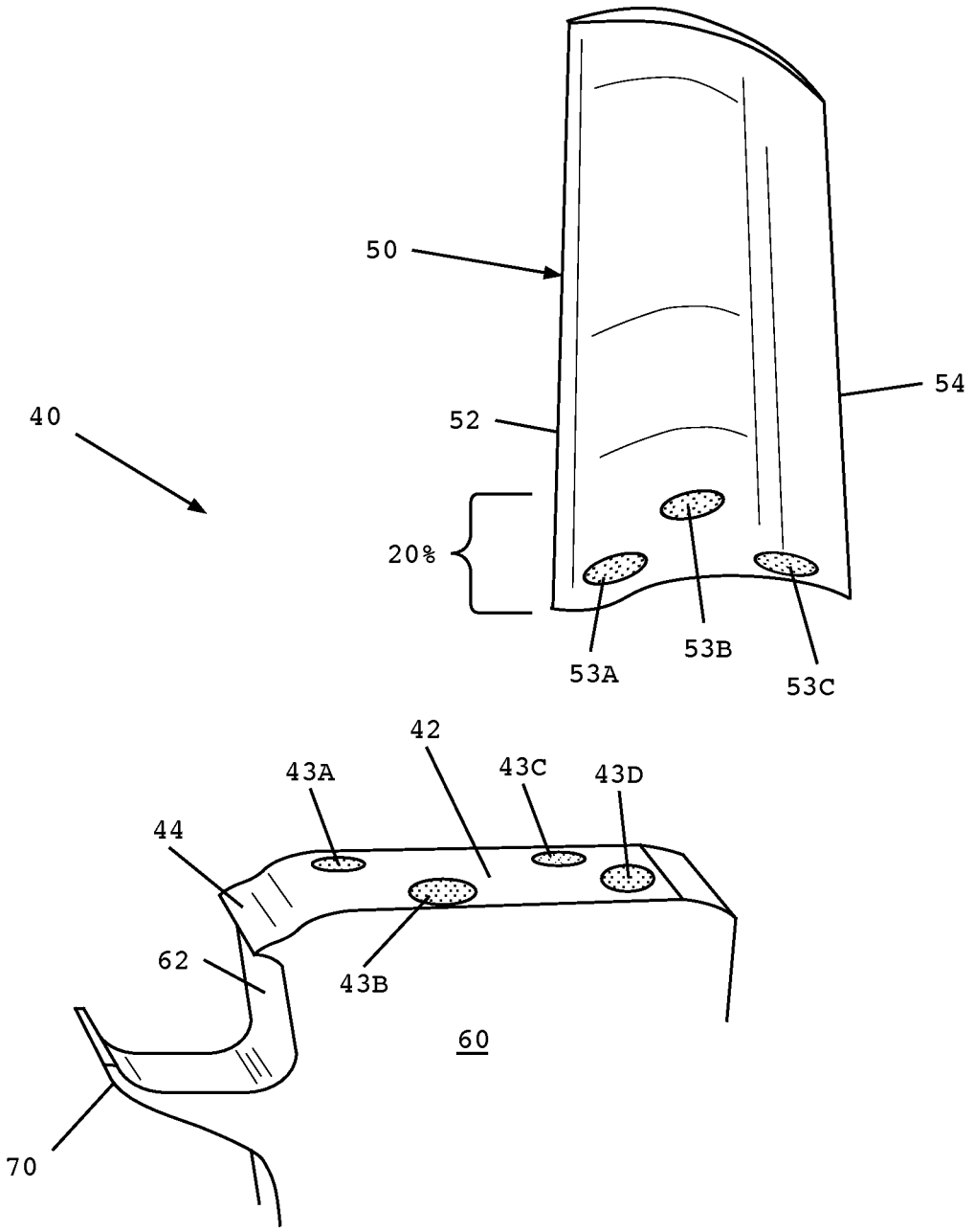
FIG. 5 shows a perspective view of the operational heating of a known turbine bucket.
Figure 6:
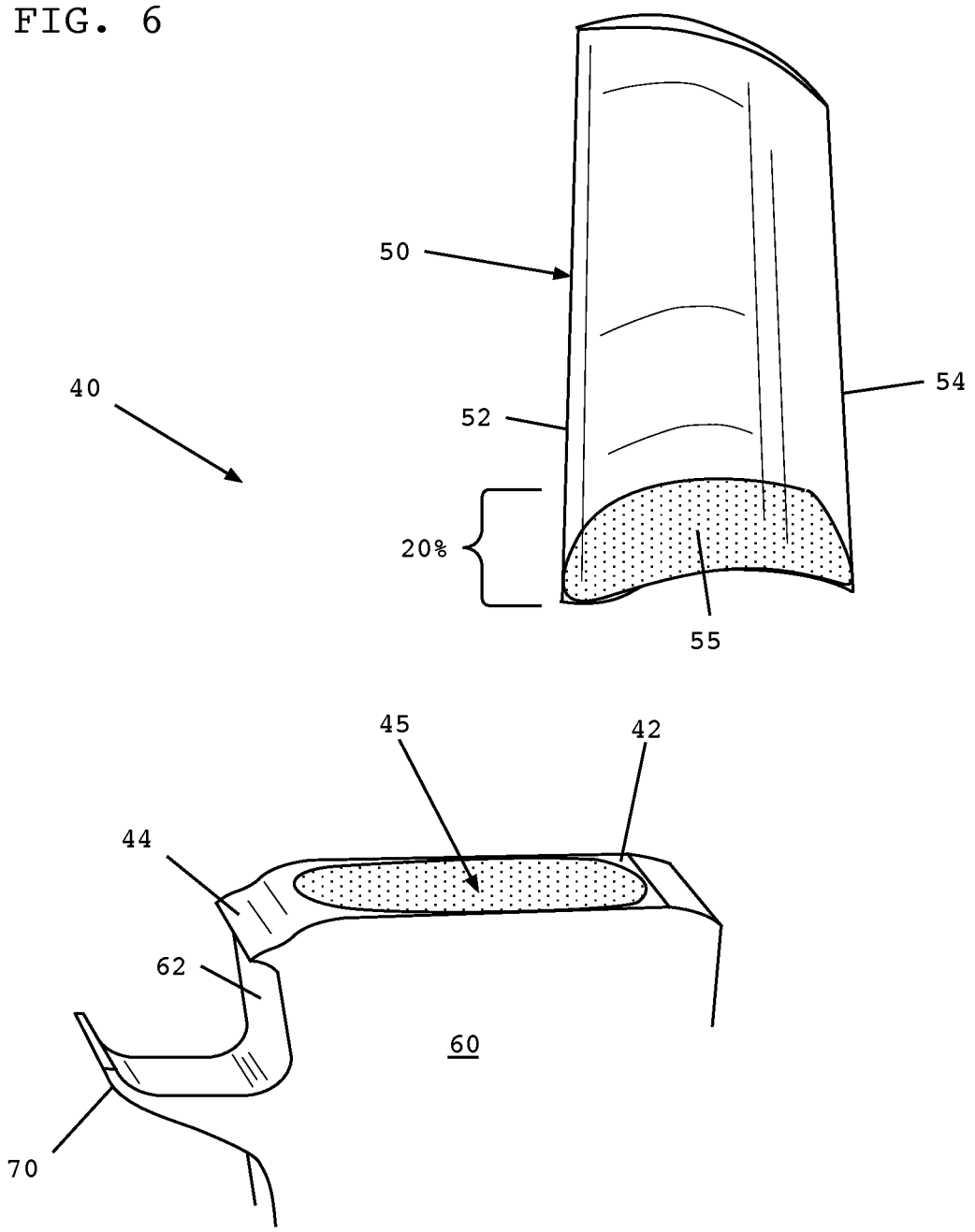
FIG. 6 shows a perspective view of the operational heating of a turbine bucket according to embodiments of the invention.

FIGS. 5 and 6 show perspective views of a bucket 40 during operation with and without, respectively, the turbulators according to embodiments of the invention. In FIGS. 5 and 6, the airfoil 50 and platform 42 are shown separately, merely for purposes of simplicity and explanation. In FIG. 5, a plurality of hot spots 43A, 43B, 43C, 43D can be seen along platform 42, a consequence of chaotic or unreduced mixing of purge air and hot gas flow, as is typical of known devices and methods. Similar hot spots 53A, 53B, 53C can be seen along airfoil 50, generally extending upward from platform 42 to about 20% of the overall length of airfoil 50. These hot spots 43A, 43B, 43C, 43D, 53A, 53B, 53C can reach temperatures in excess of 1700° F. and can cover a majority of the surface area of platform 42 and the proximal 20% of airfoil 50. What is more, the temperature differential between these hot spots 43A, 43B, 43C, 43D, 53A, 53B, 53C and other portions of platform 42 and airfoil 50 can be more than 600° F. In FIG. 6, a reduction in mixing of purge air and hot gas flow, according to embodiments of the invention, has resulted in a more even distribution of the film of cold purge gasses across platform 42, resulting in a more even cooling 45 of platform 42 and a more even cooling 55 of airfoil 50. Although temperature differences may still be observed across platform 42 and the proximal portion of airfoil 50, a larger portion of the surface area of platform 42 and airfoil 50 has a lower temperature and the temperature differential across these surfaces is significantly reduced. In some cases, the lowest recorded temperature was reduced from about 1400° F. (FIG. 5) to about 1300° F. (FIG. 6) and the highest recorded temperature reduced from about 2000° F. (FIG. 5) to about 1800° F. (FIG. 6). Some degree of improved cooling was also observed on platform lip 44 and shank face 62.

What is more, because larger portions of these surfaces were subjected to lower temperatures, the average temperature to which the overall surfaces were subjected, was reduced. This more even heating 45, 55 of platform 42 and airfoil 50, respectively, reduces thermal stresses to which these components are subjected, thereby extending its working life.

Figure 7:
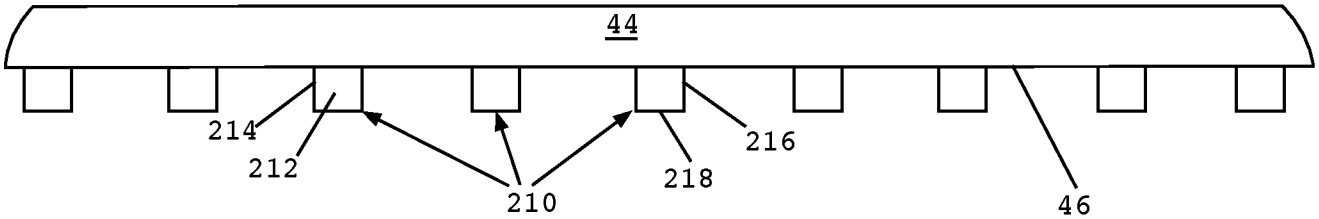
FIGS. 7-10 show schematic views of turbulators suitable for use according to various embodiments of the invention.
Figure 8:
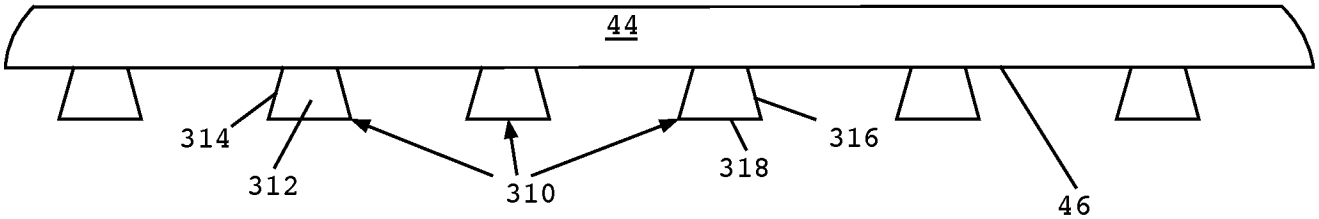
Figure 9:
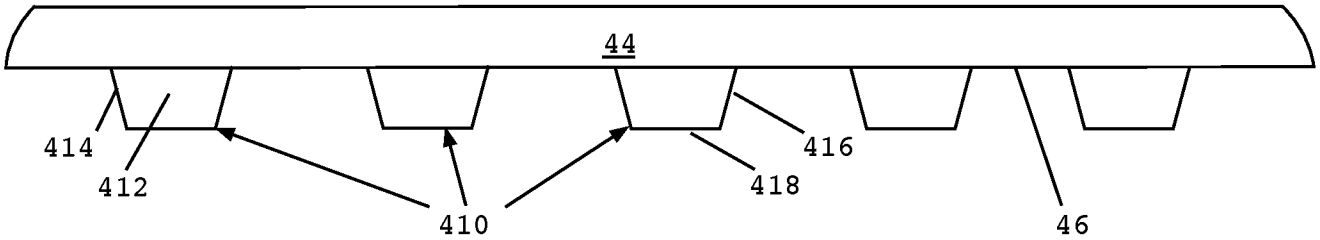
Figure 10:
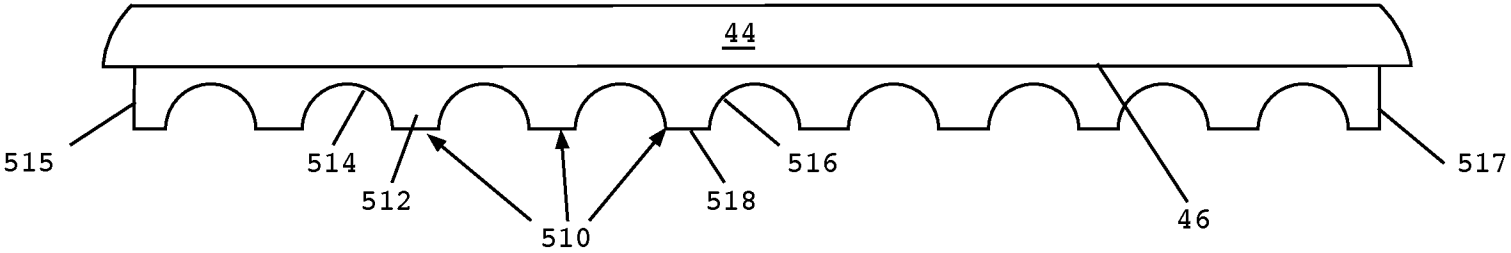

The concave turbulators in FIG. 4 are but one embodiment capable of reducing the mixing losses of purge air and hot gas flow. FIGS. 7-10, for example, show turbulators having different configurations. In FIG. 7, first and second faces 214, 216 are substantially straight and radially inner face 218 is substantially perpendicular to both first and second faces 214, 216, such that body 212 is substantially rectangular in cross-section. In other embodiments the rectangular projections may be angled to the radial or axial plane. In FIG. 8, each of first and second faces 314, 316 are substantially straight but radially non-perpendicularly angled, such that body 312 has a substantially trapezoidal cross-sectional shape, with the wider dimension disposed radially inward. In FIG. 9, on the other hand, first and second faces 414, 416 are radially non-perpendicularly angled such that body 412 has a substantially trapezoidal cross-sectional shape, with the narrower dimension disposed radially inward. In FIG. 10, each turbulator 510 is formed by the intersection of radially inner surface 518 and at least one adjacent arcuate face 514, 516 disposed on either side of radially inner surface 518. End faces 515, 517 are substantially straight and extend radially from platform lip 44, thereby enclosing the plurality of turbulators 510.

As noted above, turbulators according to embodiments of the invention may extend axially outward from face 62 and/or radially inward from a radially inner surface 46 of platform lip 44. Where turbulators extend axially outward from face 62, improvements in turbine efficiency are higher the nearer the turbulators are to the radially inner surface 46 of platform lip 44. That is, as turbulators are moved radially inward and away from inner surface 46 of platform lip 44, gains in efficiency are reduced. As will be described in greater detail below with respect to FIGS. 14 and 15, this effect is attributable to the combined ability of platform lip 44 and the turbulators to throw the purge air with the greatest velocity axially away from the shank face 62, which generates a curtaining effect against the hot gas ingestion into the wheel space cavity, which reduces the incursion of hot gas into wheelspace 26 (FIG. 1). Increasing the space between the turbulators and the platform lip 44 steadily reduces this curtaining effect induced.

Figure 11:
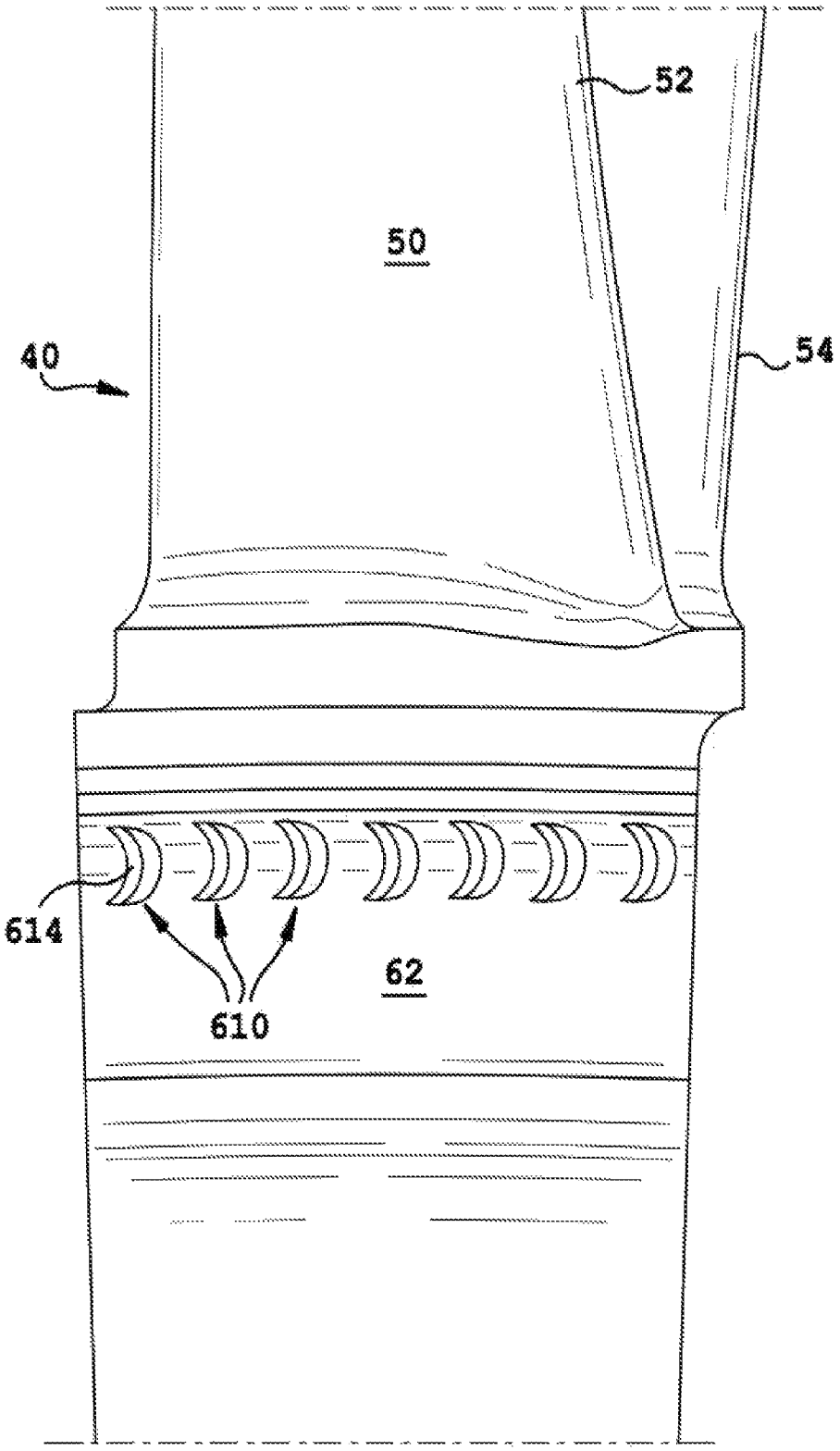
FIG. 11 shows an axially-facing view of a portion of a turbine bucket suitable for use according to another embodiment of the invention.

FIG. 11 shows a view of a portion of bucket 40 looking axially toward face 62. As can be seen in FIG. 11, each of the plurality of turbulators 110 is axially angled, such that at least first concave face 614 of each turbulator 110 is not normal to face 62. As noted above, such an embodiment may result in a change in the swirl angle of the purge air.

Figure 12:
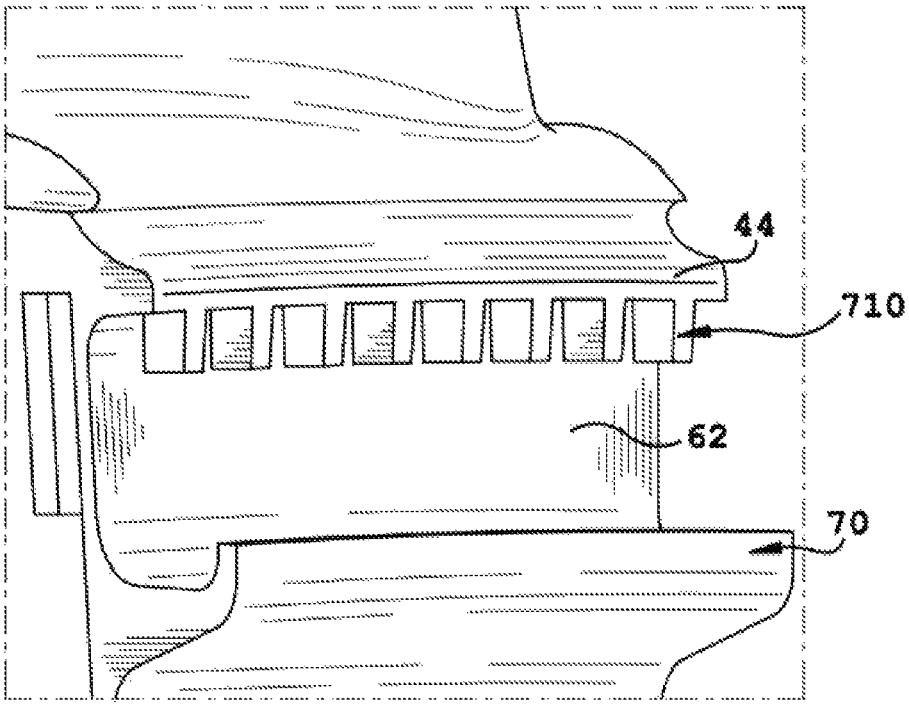
FIGS. 12 and 13 show perspective views of portions of turbine buckets suitable for use according to still other embodiments of the invention.
Figure 13:
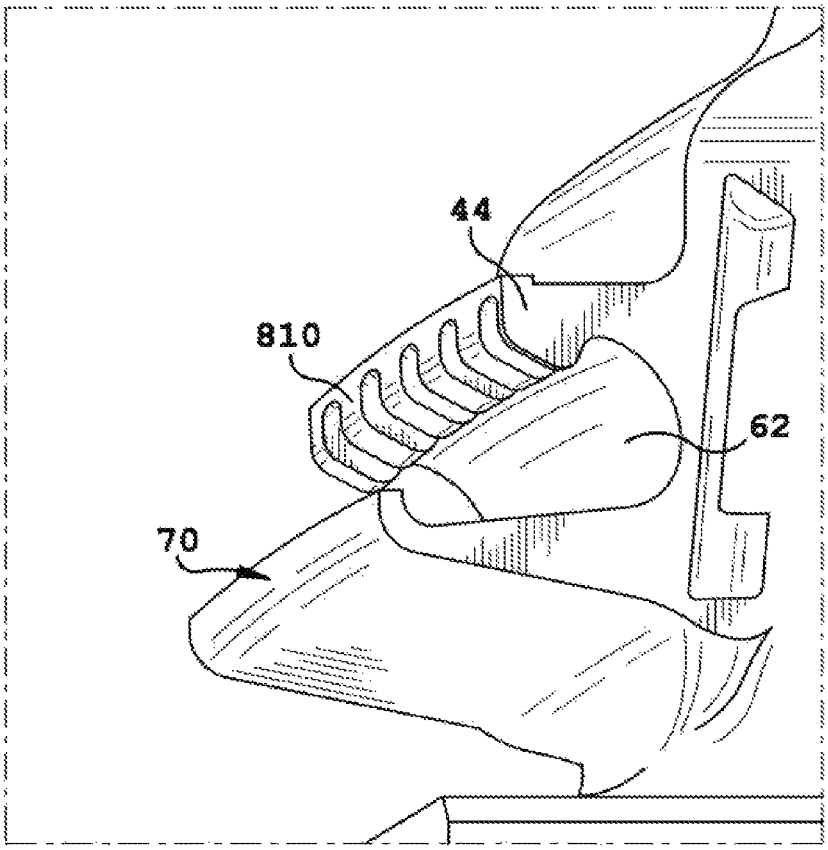

FIGS. 12 and 13 show perspective views of portions of turbine buckets according to still other embodiments of the invention. In FIG. 12, a plurality of turbulators 710 is formed (e.g., machined, cast, etc.) from additional material extending radially inward from platform lip 44. Typically, such additional material will be included in platform lip 44 at the time of casting, with subsequent machining of the cast material employed to form turbulators 710. In other embodiments of the invention, turbulators may be provided in a separate material that is welded, fastened, or otherwise secured to platform lip 44. Turbulators may contact or be axially spaced from face 62. In FIG. 13, for example, turbulators 810 similarly extend from radially inward from platform lip 44 but are axially spaced from face 62, which, in the embodiment shown, is curved. These projections of the turbulators may be angled to the radial and/or axial plane.

Although the turbulators 710, 810 shown in FIGS. 12 and 13, respectively, are shown having a substantially rectangular cross-sectional shape, this is neither necessary nor essential. Such turbulators, may have any number of cross-sectional shapes, including, for example, those described above with respect to FIGS. 4 and 7-10. Similarly, any such turbulators may be axially angled, as described above with respect to FIG. 11.

Figure 15:
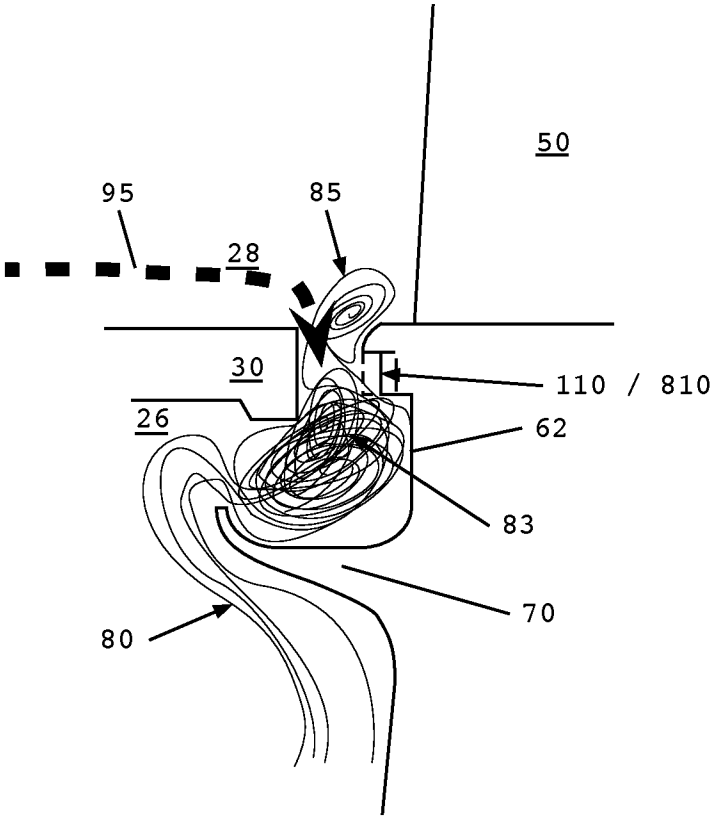
FIG. 15 shows a schematic view of purge air flow in relation to a turbine bucket according to an embodiment of the invention.
Figure 14:
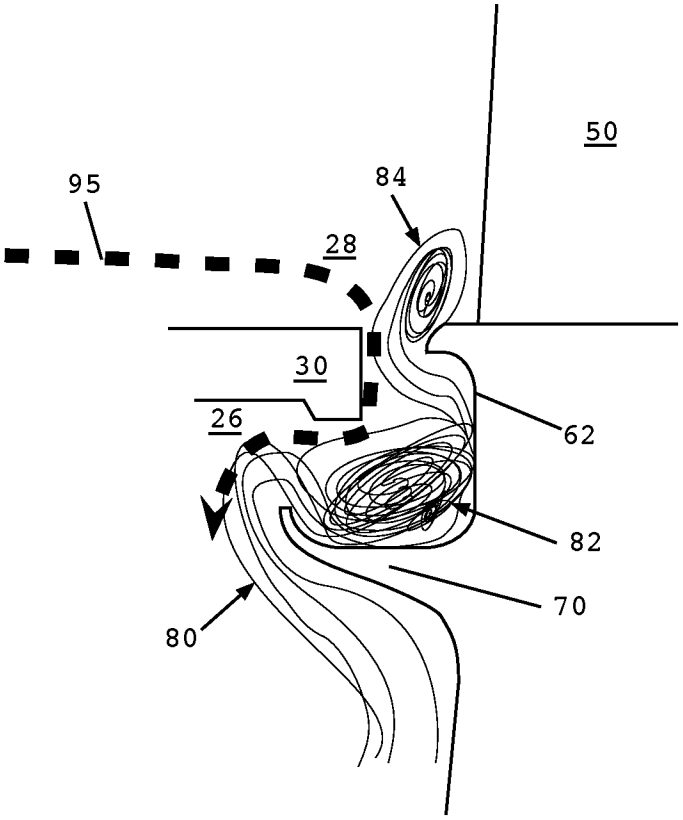
FIG. 14 shows a schematic view of purge air flow in relation to a typical turbine bucket.

FIGS. 14 and 15 show, respectively, schematic representations of purge gas flows in a known gas turbine and in a gas turbine including turbulators according to embodiments of the invention. In FIG. 14, purge air 80 is shown and has a low axial momentum and the extent of its reaches is confined to area 82, where it forms a vortex and eventually escapes into the hot gas flowpath 28. The concentration of purge air 80 thrown out axially from the blade shank surface due to its natural curvature towards area 82, is only confined to distances closer to face 62, which allows for incursion of hot gas 95 into wheelspace 26.

In contrast, FIG. 15 shows the effect of turbulators 110-810 on purge air 80 according to various embodiments of the invention. As can be seen in FIG. 15, the area 83 in which purge air is thrown out with higher axial momentum/velocity is distanced further from face 62. In addition, this area 83 of purge air has been moved axially away from face 62, as compared to FIG. 14. At the same time, any escaping purge air 85 has been moved away from platform lip 44 (FIG. 12-13) toward nozzle 30. This, in effect, produces a curtaining effect, restricting incursion of hot gas 95 from hot gas flowpath 28 and eventually escapes from wheelspace 26 into hot gas flowpath 28. Hence, because of the enhanced curtaining/sealing effectiveness of these embodiments presented here, implementing these could lower the purge flow requirement still retaining same/higher sealing effecting against hot gas ingestion into the wheel-space cavity.

In addition, as a result of the lower hot gas ingestion, additional components in vicinity of the wheelspace 26, including nozzle surface 30, are cooled. Typically, embodiments of the invention have been shown to cool nozzle surface 30 by 100° F. to 400° F.

The increases in turbine efficiencies achieved using embodiments of the invention can be attributed to a number of factors. First, as noted above, increases in swirl velocity of purge air into hot gas flowpath 28 reduce the mixing losses attributable to purge air. Further, the curtaining effect induced by turbulators according to the invention reduce or prevent the incursion of hot gas 95 into wheelspace 26, and prevents heating of wheel space cavity due to less or no hot gas ingestion. Each of these contributes to the increased efficiencies observed.

In addition, the overall quantity of purge air needed is reduced for at least two reasons. First, a reduction in escaping purge air necessarily reduces the purge air that must be replaced, and has a direct, favorable effect on turbine efficiency. Second, a reduction in the incursion of hot gas 95 into wheelspace 26 reduces the temperature rise within wheelspace 26 and the attendant need to reduce the temperature through the introduction of additional purge air. Each of these reductions to the total purge air required reduces the demand on other system components, such as the compressor from which the purge air is provided.

Figure 16:
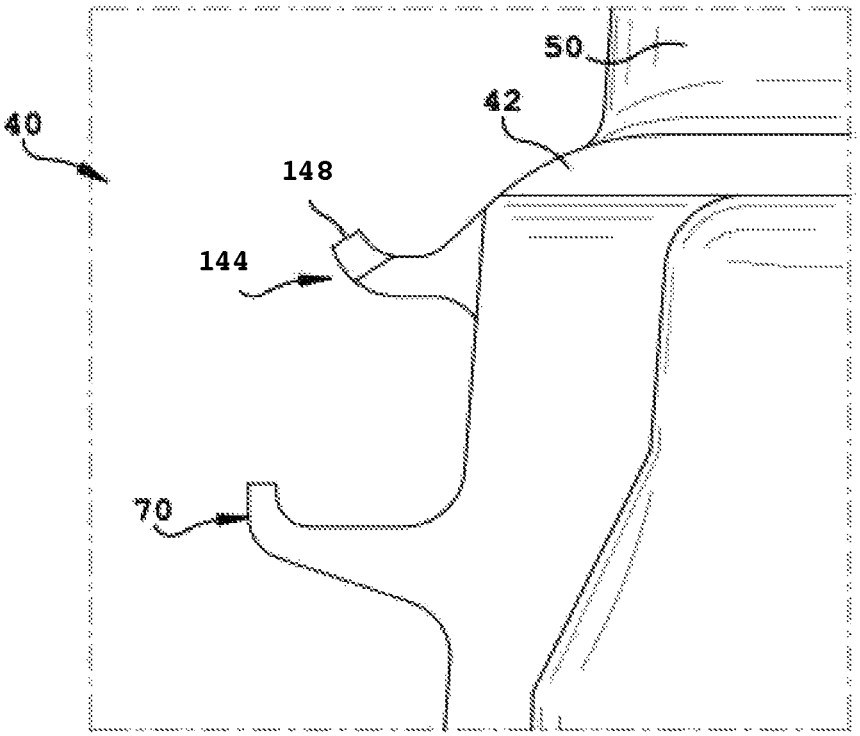
FIG. 16 shows a cross-sectional side view of a portion of a turbine bucket suitable for use according to an embodiment of the invention.

The lower temperatures in the bucket platform 42, the platform lip 44 and the bucket shank face and a more even distribution of the film of cold purge gasses across platform 42 may be achieved according to other embodiments as well. For example, FIG. 16 shows a cross-sectional side view of a portion of a turbine bucket 40 according to an embodiment of the invention. As can be seen in FIG. 16, a distal end 48 of platform lip 44 is angled radially outward toward airfoil 50.

Figure 17:
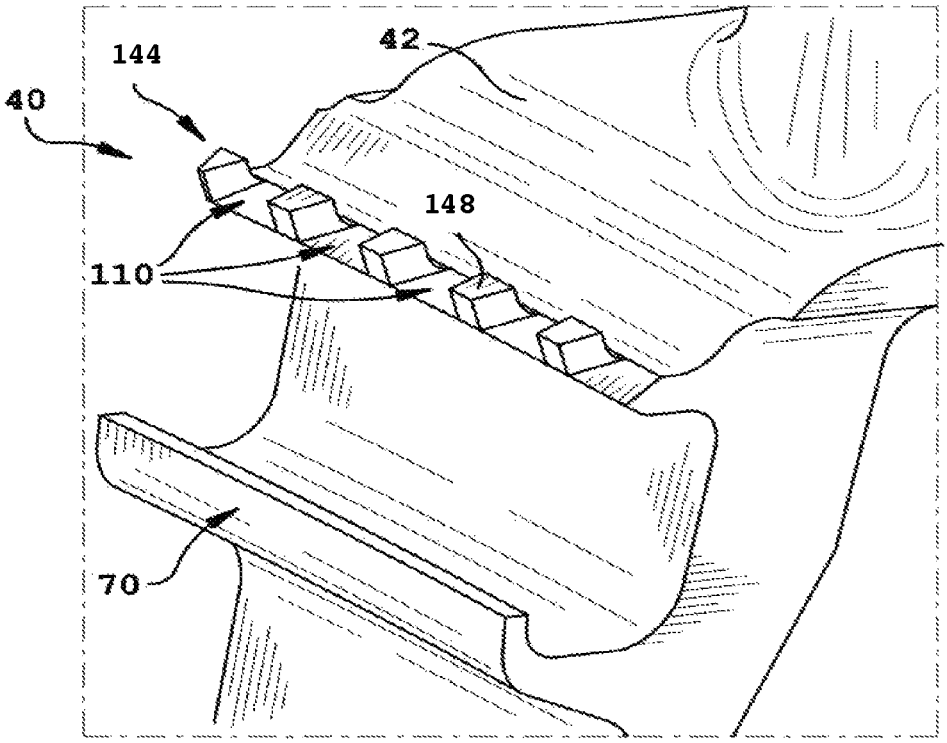
FIG. 17 shows a perspective view of the portion of the turbine bucket of FIG. 16.

FIG. 17 shows a perspective view of the bucket 40 of FIG. 3. A plurality of voids 110 are provided along distal end 148 of platform lip 144. As shown in FIG. 17, voids 110 are substantially trapezoidal in shape, although this is neither necessary nor essential. Voids having other shapes may also be employed, including, for example, rectangular, rhomboid, or arcuate shapes.

Figure 18:
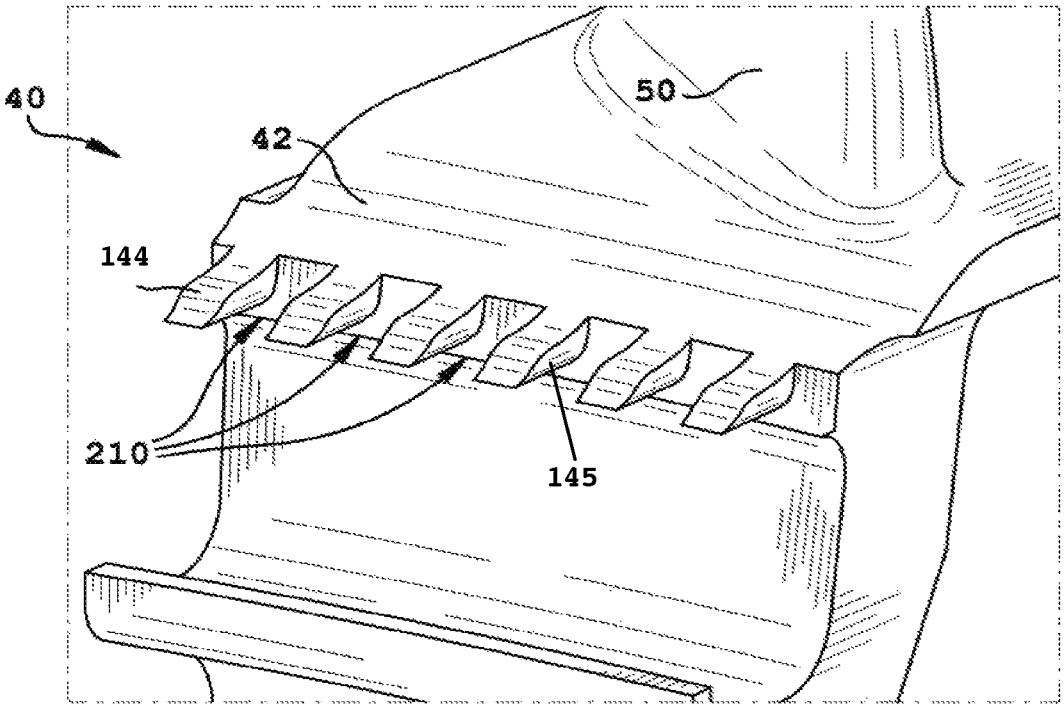
FIG. 18 shows a perspective view of a portion of a turbine bucket suitable for use according to another embodiment of the invention.

For example, FIG. 18 shows a perspective view of a bucket 40 according to another embodiment of the invention. Here, platform lip 144 extends axially from platform 42 (i.e., a distal end is not angled toward airfoil 50, as in FIGS. 3 and 4). Voids 210 extend through platform lip 144 in an arcuate path such that remaining portions of platform lip 144 adjacent voids 210 include an arcuate face 145.

Figure 19:
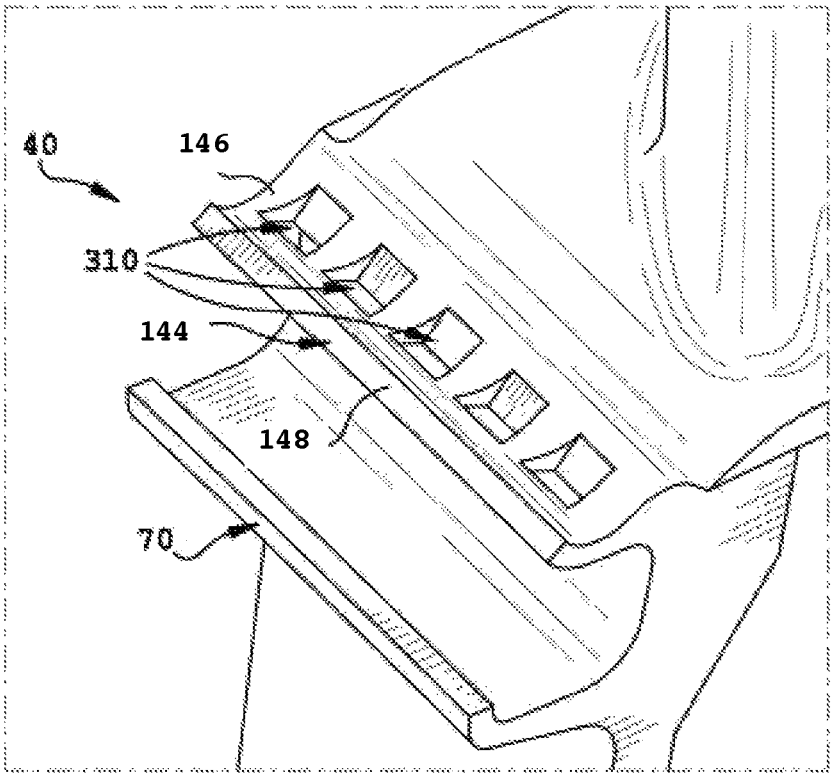
FIG. 19 shows a perspective view of a portion of a turbine bucket suitable for use according to yet another embodiment of the invention.

The embodiment of the invention shown in FIG. 19 shows a perspective view of bucket 40. Here, platform lip 144 includes an angled distal end 48, as in FIGS. 16 and 17. However, voids 310 are formed in a body 146 of platform lip 144 rather than at its distal end 148. As noted above, voids 310 may take any number of shapes, including, for example, rectangular, trapezoidal, rhomboid, arcuate, etc.

Figure 20:
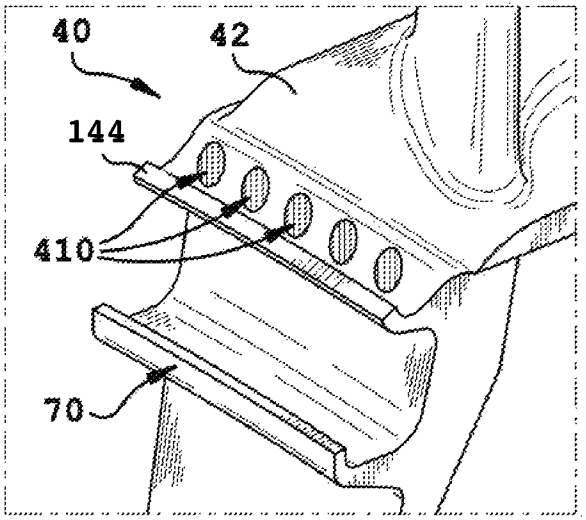
FIGS. 20-26 show perspective views of turbine buckets suitable for use according to still other embodiments of the invention.
Figure 21:
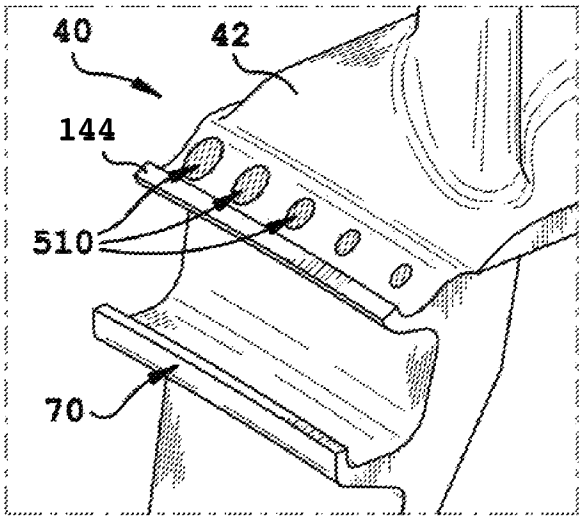
Figure 22:
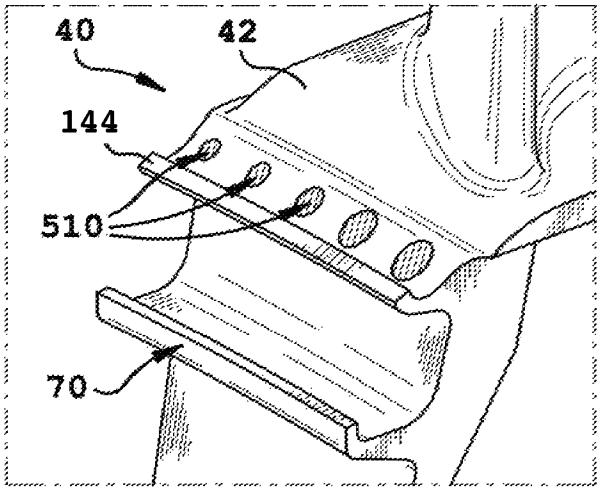

FIGS. 20-22 show perspective views of other embodiments of the invention. In FIG. 20, voids 410 are elliptical in shape and angled with respect to a radial axis of bucket 40.

In FIG. 21, elliptical voids 510 of differing sizes are employed with void size increasing along platform lip 144 from an end nearer the concave trailing face toward the convex leading face of airfoil 50. In such an embodiment, the effect of voids 510 on purge air between platform lip 144 and angel wing 70 will generally be more pronounced adjacent the larger voids. This may be desirable, for example, where the amount of purge flow passing circumferentially over platform 42 needs to be controlled for various reasons, for example, to make the cooling more uniform by pushing more cold purge flow where a hot spot is expected on platform 42.

In FIG. 22, elliptical voids 510 of differing size are employed with void size decreasing along platform lip 144 from an end nearer the concave trailing face toward the convex leading face of airfoil 50. As should be recognized from the discussion above, such an embodiment may be desirable, for example, where a loss of purge air or an incursion of hot gas is greater in the area of the larger voids.

FIGS. 23-26 show perspective views of turbine buckets 40 in accordance with various embodiments of the invention. In each of the embodiments in FIGS. 23-26, voids are disposed unevenly along platform lip 144.

Figure 23:
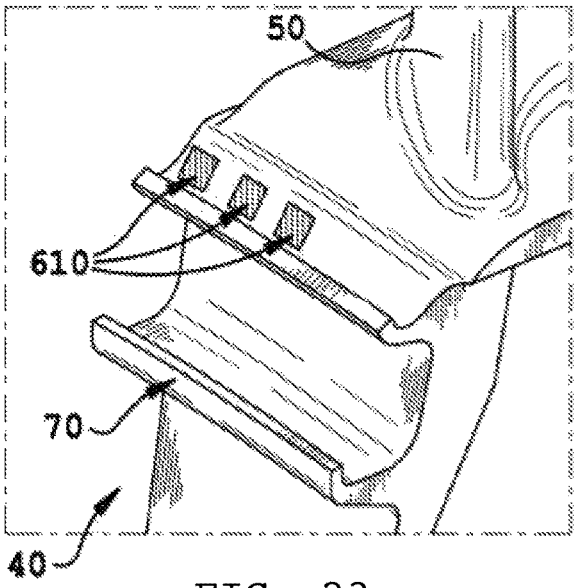

In FIG. 23, a plurality of substantially rectangular voids 610 are disposed along platform lip 144 nearer the convex leading face than the concave trailing face of airfoil 50.

Figure 24:
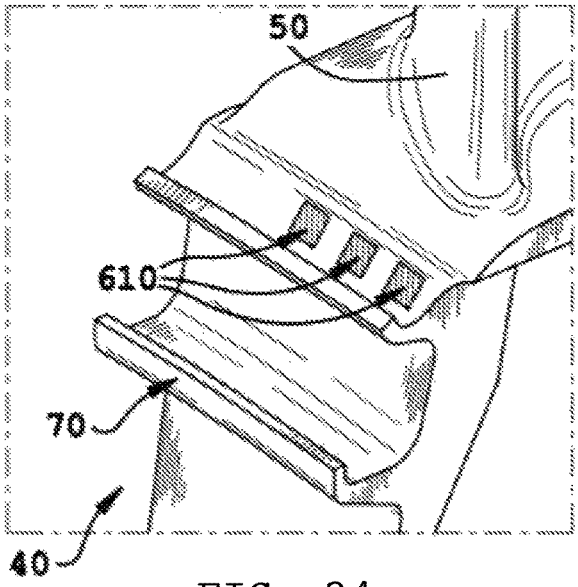

In FIG. 24, the area of void concentration is opposite that in FIG. 23, with the plurality of substantially rectangular voids 610 disposed along platform lip 144 nearer the concave trailing face than the convex leading face of airfoil 50.

Figure 25:
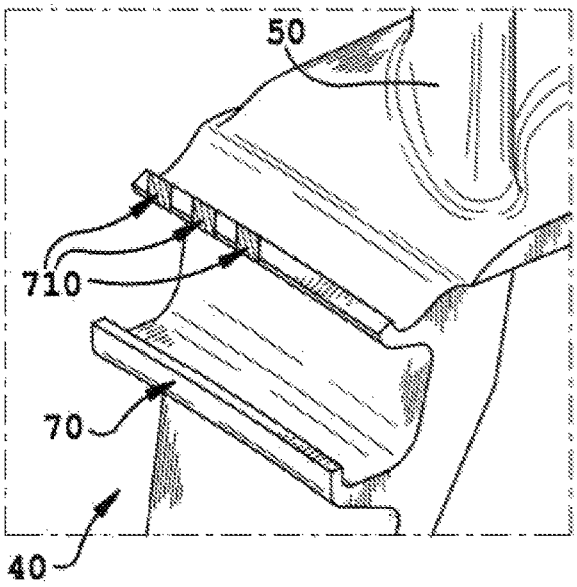
Figure 26:
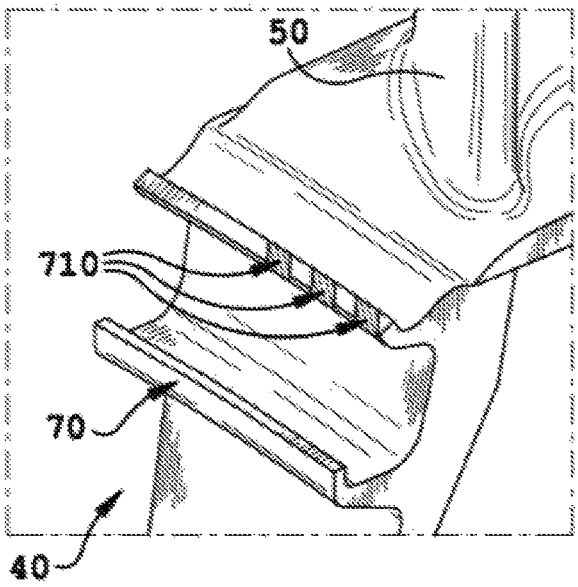

FIGS. 25 and 26 show embodiments similar to those in FIGS. 23 and 24, respectively, in which voids 710 are notches of material removed from an edge of platform lip 144 (FIG. 22). The use of voids 710 on the edge of platform lip 144 may be employed, for example, to direct purge air toward either convex leading face or concave trailing face of airfoil 50.

Figure 27:
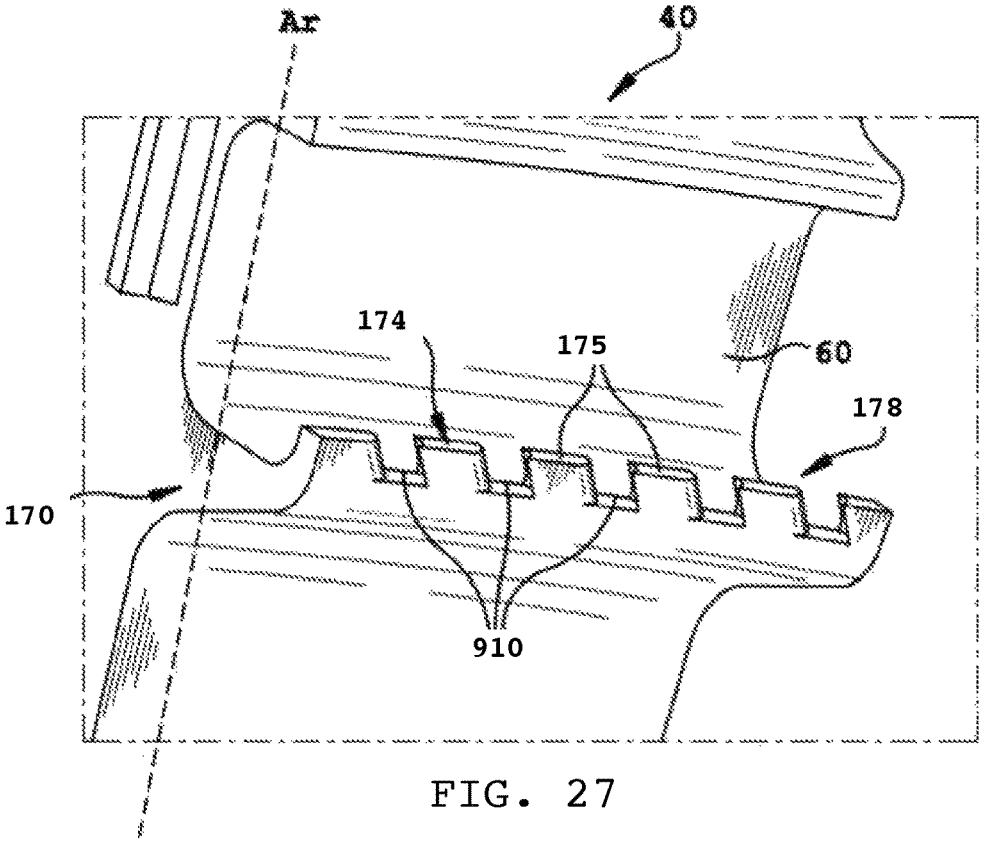
FIG. 27 shows a perspective view of a portion of a turbine bucket suitable for use according to an embodiment of the invention.

The more even distribution of the film of cold purge gasses across platform 42 may be achieved according to still other embodiments as well. For example, FIG. 27 shows a perspective view of a portion of a turbine bucket 40 according to an embodiment of the invention. As can be seen in FIG. 27, a plurality of voids 910 are disposed along an angel wing rim 174 at a distal end 178 of angel wing 170. Voids 910 are spaced along angel wing rim 174 such that the remaining portions of angel wing rim 174 form a plurality of column members 175. As shown in FIG. 27, voids 910 are radially angled, i.e., angled with respect to a radial axis (Ar) of turbine bucket 40, although this is neither necessary nor essential. In other embodiments of the invention, voids may be substantially parallel to a radial axis of the turbine bucket.

Figure 28:
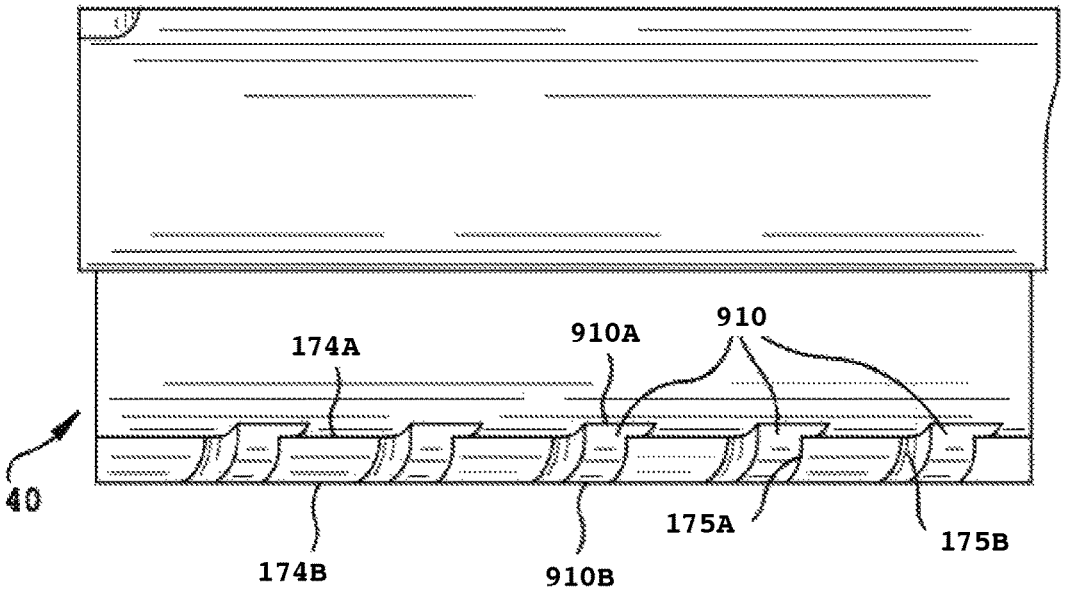
FIG. 28 shows a radially inward view of a portion of the turbine bucket of FIG. 27.

As shown most clearly in FIG. 28, a radially-inward looking view of turbine bucket 40, column members 175 (and correspondingly voids 910) include arcuate faces. Specifically, column members 175 include a concave face 175A (a convex face of void 910) and a convex face 175B (a concave face of void 910). As such, void 910 includes a first opening 910A along an axially inner surface 174A of angel wing rim 174 disposed laterally to a second opening 910B along an axially outer surface 174B of angel wing rim 174. It should be understood, of course, that column members and voids may have other shapes. For example, column members and voids may include rectangular, trapezoidal, or any other cross-sectional shape.

Figure 29:
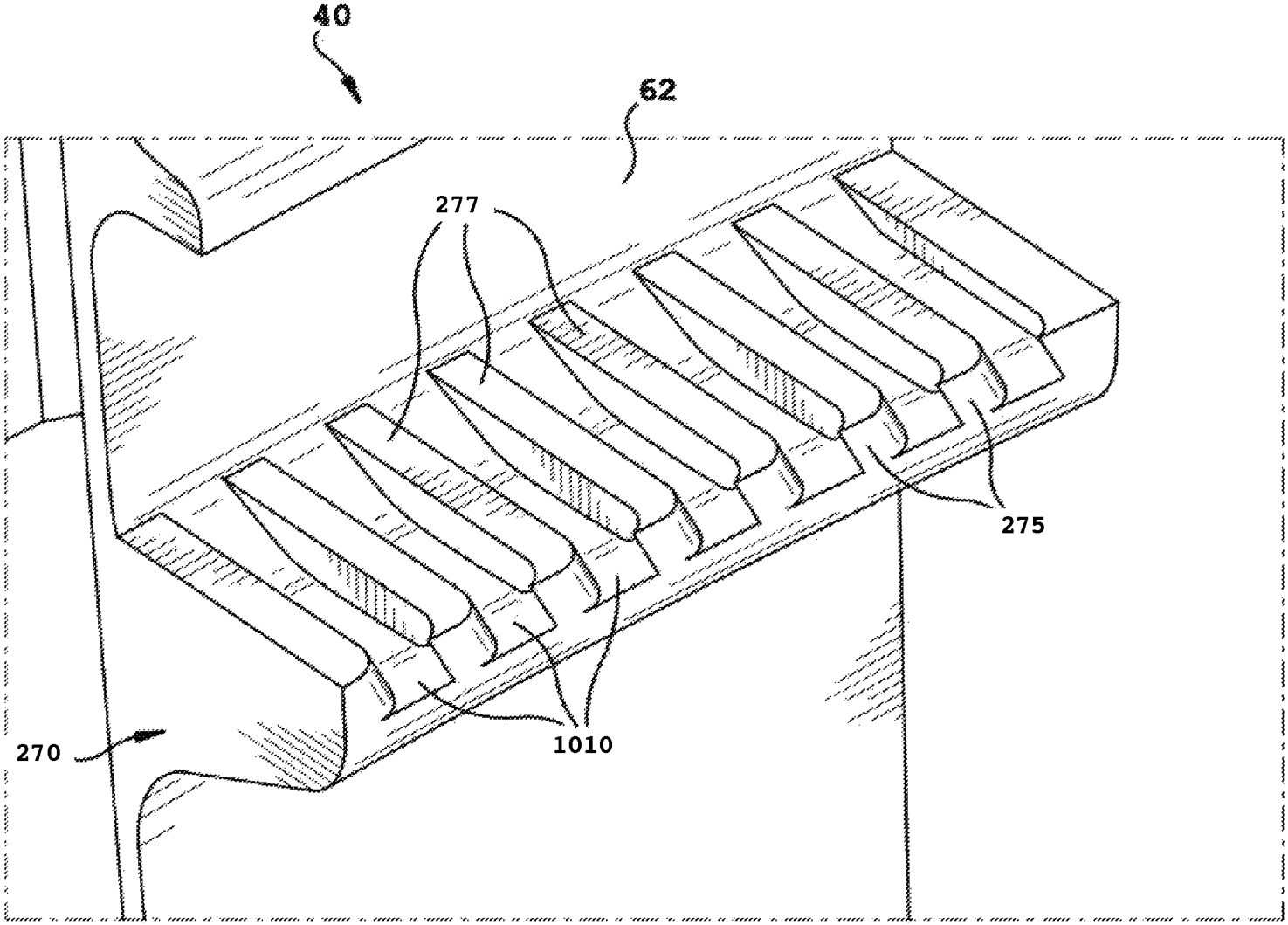
FIG. 29 shows a perspective view of a portion of a turbine bucket suitable for use according to another embodiment of the invention.

FIG. 29 shows a perspective view of a portion of a turbine bucket 40 according to another embodiment of the invention. Here, a plurality of dam members 277, which are adjacent to the radially outer surface of the angel wing seal, extend axially from shank portion 60 to each of the plurality of column members 275. According to some embodiments, dam members 277 may be angled with respect to a radial axis of turbine bucket 40, i.e., angled positively or negatively with respect to the direction of rotation of turbine bucket 40. Similarly, according to some embodiments, dam members 277 may include one or more arcuate faces, as do column members 275, or may include rectangular, trapezoidal, or any other cross-sectional shape, such as described above.

Figure 30:
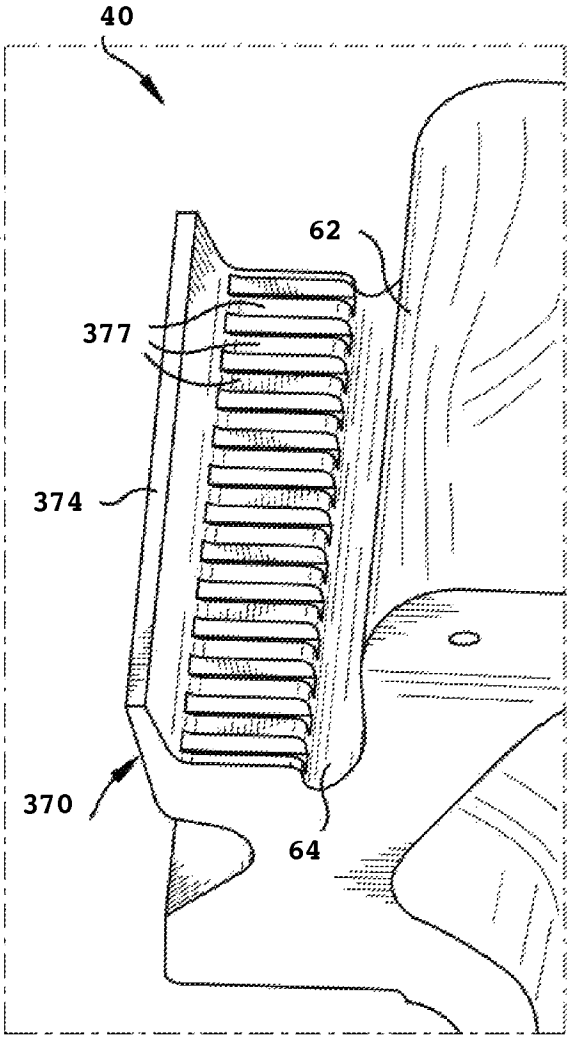
FIG. 30 shows a perspective view of a portion of a turbine bucket suitable for use according to yet another embodiment of the invention.

FIG. 30 shows a perspective view of a portion of a turbine bucket 40 according to another embodiment of the invention. Here, a continuous angel wing rim 374 extends upward from angel wing seal 370 and a plurality of dam members 377 extend axially from rim 374 toward but not contacting face 62, leaving a gap 64 adjacent face 62.

Figure 31:
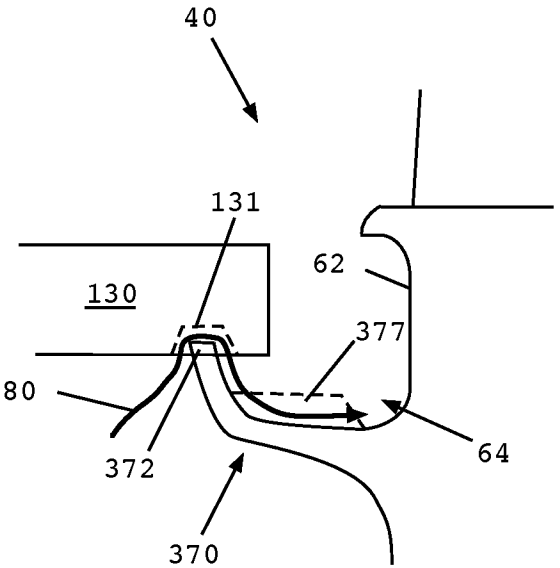
FIG. 31 shows a cross-sectional side view of the turbine bucket of FIG. 30.

FIG. 31 shows a cross-sectional side view of turbine bucket 40 of FIG. 30 with respect to a nozzle surface 130 according to an embodiment of the invention. In FIG. 31, nozzle surface 130 comprises or includes a porous or erodible portion along at least a radially inward surface, such that angel wing rim 374 cuts or wears a groove 131 into nozzle surface 130. The porous or erodible portion of nozzle surface 130 may comprise the material of nozzle surface 130 in a "honey comb" or similar pattern, such that the porous or erodible portion is subject to wear or erosion by angel wing rim 374. In other embodiments of the invention, the porous or erodible portion of nozzle surface 130 may comprise or include a material that is softer than the other material(s) of nozzle surface 130, such that the porous or erodible portion is similarly subject to wear or erosion by angel wing rim 374.

In operation, purge air 80 passes into groove 131 of nozzle surface 130 and then downward between dam members 377, toward face 62. Purge air 80 then flows circumferentially within gap 64, adjacent face 62, as turbine bucket 40 rotates, providing increased swirl to purge air 80.

Figure 32:
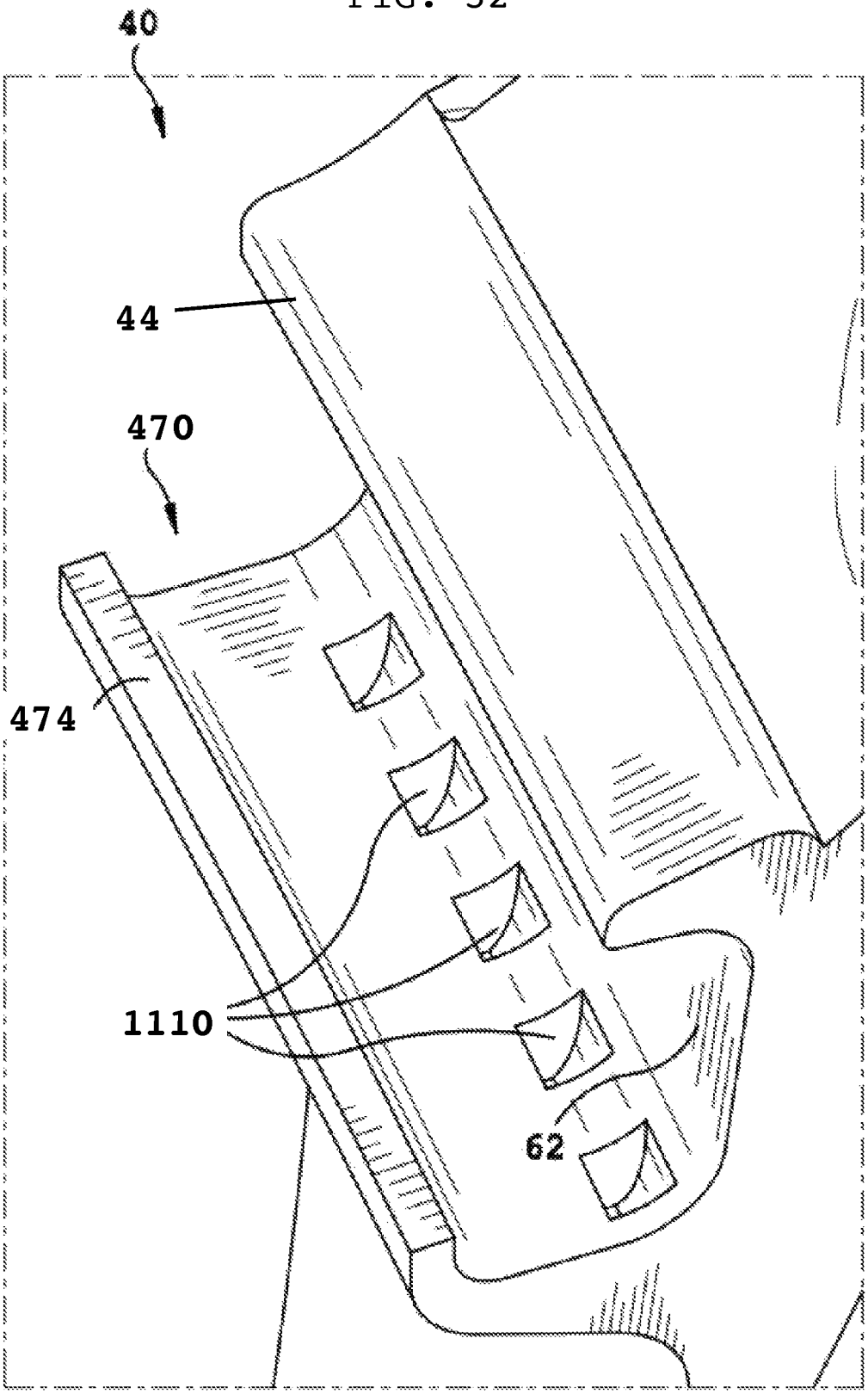
FIG. 32 shows a perspective view of a portion of a turbine bucket according to an embodiment of the invention.

As should be apparent from the description above, other modifications to the angel wing may be employed reduce to mixing between purge air and hot gas flow achieve a more even distribution of the hot gas flow across platform 42. For example, FIG. 32 shows a perspective view of a portion of a turbine bucket 40 according to an embodiment of the invention. As can be seen in FIG. 32, a plurality of voids 1110 extend radially through angel wing 470. As shown in FIG. 32, the plurality of voids 1110 is disposed axially inwardly along angel wing 470, closer to face 62 than angel wing rim 474. Each of the plurality of voids 1110 is shown in FIG. 32 having a rectangular cross-sectional shape (i.e., a rectangular shape looking radially inward), although this is neither necessary nor essential. As will be recognized by one skilled in the art, any number of cross-sectional shapes may be employed and are within the scope of the invention.

As shown in FIG. 32, the plurality of voids 1110 is substantially evenly disposed along a length of angel wing 470. It is noted, however, that this is neither necessary nor essential. According to other embodiments of the invention, the plurality of voids 1110 may be unevenly disposed along the length of angel wing 470, such that voids are more numerous at one end of angel wing 470 than the other end, are more numerous toward a middle portion of angel wing 470, or any other configuration.

Figure 33:
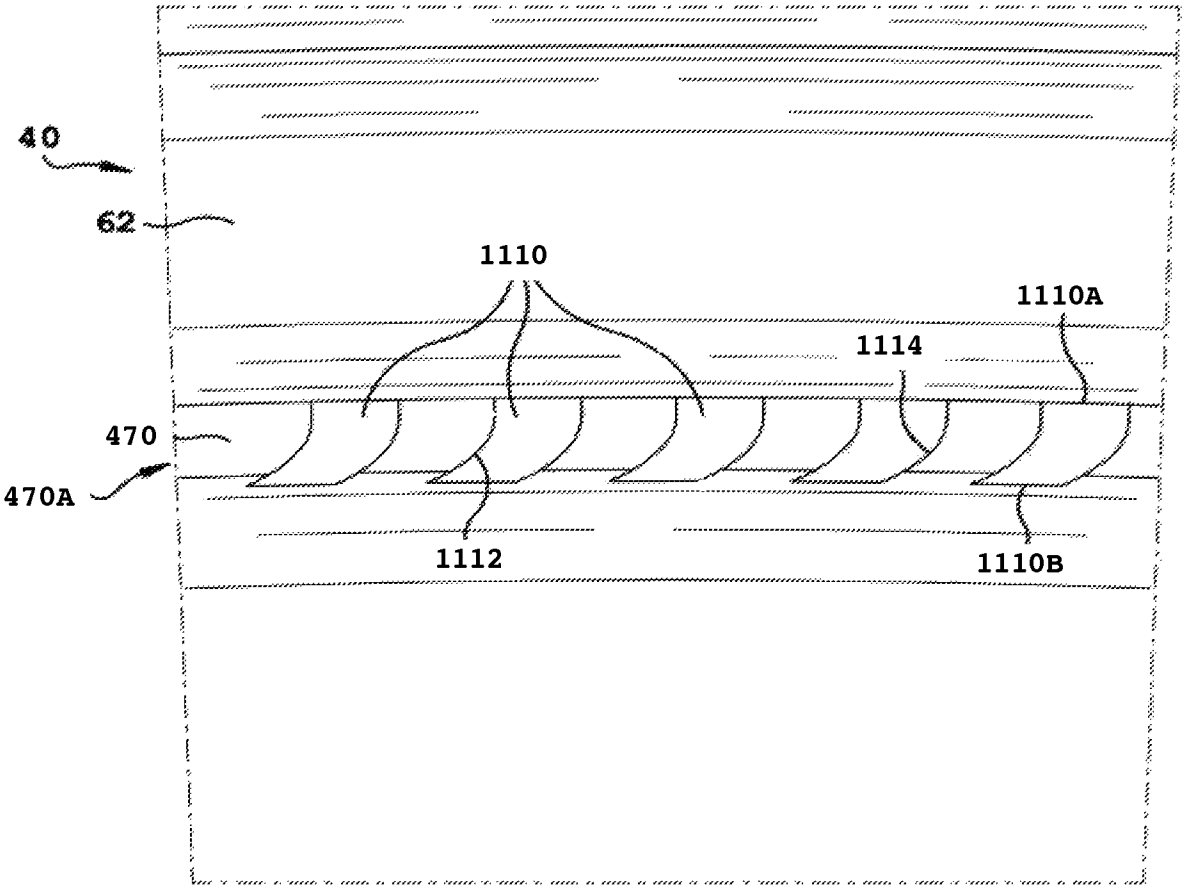
FIG. 33 shows an axially-inwardly looking view of a portion of the turbine bucket of FIG. 32.

FIG. 33 shows an axially-inwardly looking cross-sectional view of a portion of turbine bucket 40 taken through angel wing 470. As can be seen in FIG. 33, and according to one embodiment of the invention, voids 1110 include a convex face 1112 and a concave face 1114, forming a curved or arcuate passage through angel wing 470. That is, voids 1110 follow a path from radially outward opening 1110A, along convex face 1112 and concave face 1114, to radially inward opening 1110B. Radially inward opening 1110B is thereby disposed closer to end 470A of angel wing 470 than is radially outward opening 1110A.

This curved or arcuate shape of voids 1110 through angel wing 470 increases a swirl velocity of purge air between angel wing 470 and platform lip 44. As explained above in accordance with other embodiments of the invention, this produces a curtaining effect, restricting incursion of hot gas into wheelspace 26 (FIG. 1) while simultaneously reducing the quantity of purge air escaping from wheelspace 26.

Figure 34:
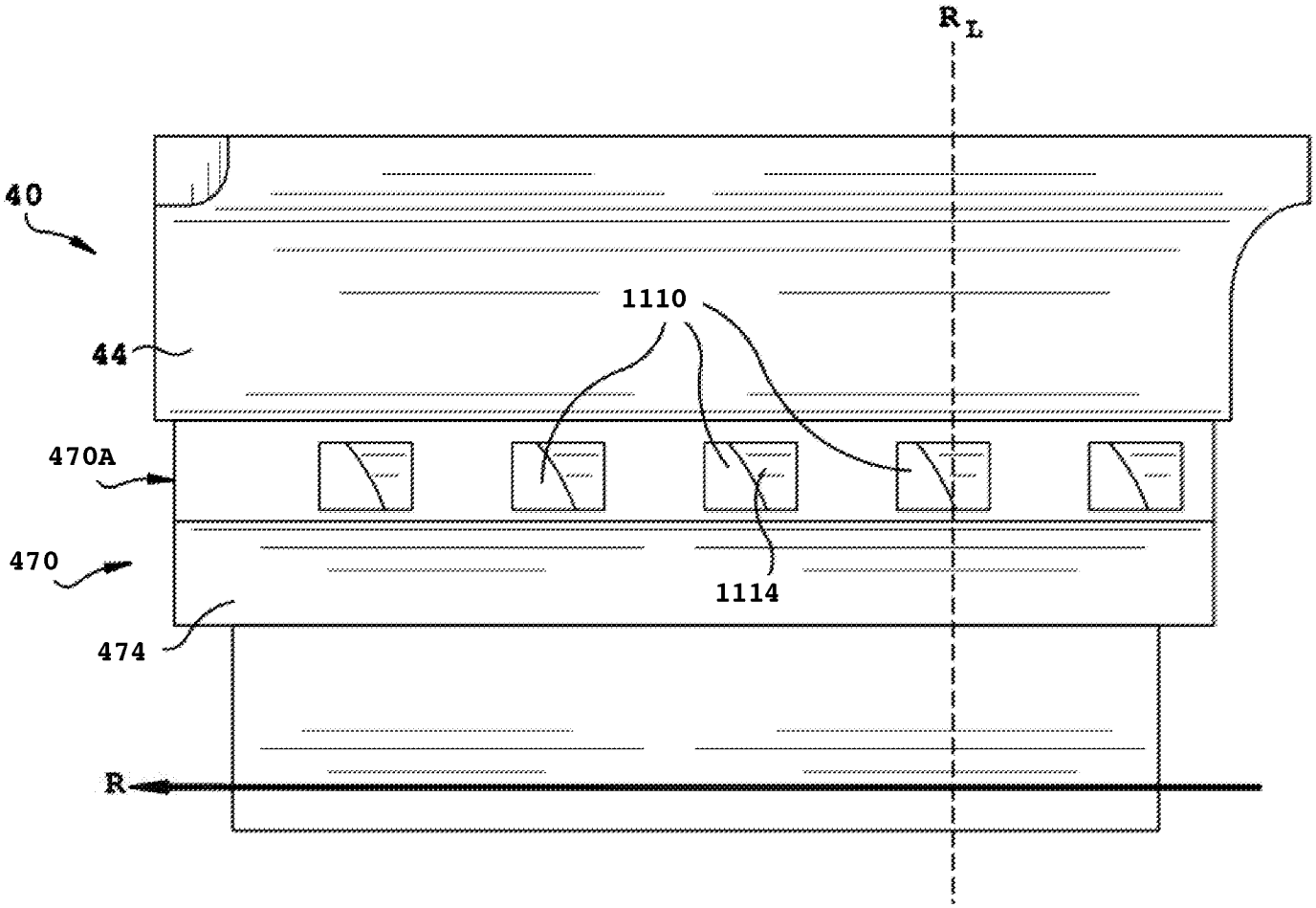
FIG. 34 shows a radially-downward looking view of a portion of the turbine bucket of FIG. 32.

FIG. 34 shows a radially-downward looking view of a portion of turbine bucket 40. Concave faces 1114 of each void 1110 can be seen. In addition, as shown in FIG. 32, concave faces 1114 are axially angled as well. That is, concave faces 1114 are angled with respect to both a longitudinal axis RL and a direction of rotation R of turbine bucket 40. Thus, the shape of voids 110 as they pass radially outward through angel wing 470 would impart a swirl to the purge gas, directing the purge gas both axially, toward angel wing rim 474 and laterally toward end 470A of angel wing 470.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of cooling at least a portion of a turbine bucket, the method comprising:

during operation of a turbine, imparting a curtaining effect on purge air beneath a platform lip extending axially from a platform, wherein imparting the curtaining effect on the purge air includes interrupting a flow of the purge air with a plurality of voids disposed along an angel wing, the angel wing extending axially from a face of a shank portion of the turbine bucket beneath the platform lip, each of the plurality of voids bounded by a convex face and a concave face, wherein the plurality of voids extend through the angel wing from a radially outward opening along the convex face to a radially inward opening along the concave face, wherein each of the plurality of voids is curved in shape with the curved shape of the voids directed radially, wherein each of the concave faces is angled with respect to both a longitudinal axis of the turbine bucket and a direction of rotation of the turbine bucket, the radially outward opening trailing the radially inward opening with respect to the direction of rotation of the turbine bucket, wherein the concave face is trailing the convex face relative to the direction of rotation of the turbine bucket.

2. The method of claim 1, wherein each of the plurality of voids includes a rectangular cross-sectional shape.

3. The method of claim 1, wherein the plurality of voids is unevenly distributed along a length of the angel wing.

4. The method of claim 1, wherein the portion of the turbine bucket is selected from a group consisting of: the platform, the platform lip, an airfoil, and a shank face.

5. The method of claim 1, wherein the method further comprises cooling a nozzle surface adjacent the turbine bucket.

6. A method of cooling at least a portion of a turbine bucket, the method comprising:

during operation of a turbine, imparting a curtaining effect on purge air beneath a platform lip extending axially from a platform, wherein imparting the curtaining effect on the purge air includes interrupting a flow of the purge air with a plurality of voids disposed along an angel wing, the angel wing extending axially from a face of a shank portion of the turbine bucket beneath the platform lip, each of the plurality of voids bounded by a convex face and a concave face, wherein the plurality of voids extend through the angel wing from a radially outward opening along the convex face to a radially inward opening along the concave face, wherein each of the plurality of voids is curved in shape with the curved shape of the voids directed radially, wherein each of the concave faces is circumferentially, radially, and axially angled with respect to both a longitudinal axis of the turbine bucket and a direction of rotation of the turbine bucket, the radially outward opening trailing the radially inward opening with respect to the direction of rotation of the turbine bucket, wherein the concave face is trailing the convex face relative to the direction of rotation of the turbine bucket, and wherein each of the plurality of voids includes a rectangular cross-sectional shape.

* * * * *